US007246578B2

(12) United States Patent
Nakamura et al.

(10) Patent No.: US 7,246,578 B2
(45) Date of Patent: Jul. 24, 2007

(54) VALVE OPERATING MECHANISM OF INTERNAL COMBUSTION ENGINE

(75) Inventors: Makoto Nakamura, Kanagawa (JP); Mikihiro Kajiura, Tokyo (JP); Seinosuke Hara, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 207 days.

(21) Appl. No.: 11/055,096

(22) Filed: Feb. 11, 2005

(65) Prior Publication Data

US 2005/0178350 A1 Aug. 18, 2005

(30) Foreign Application Priority Data

Feb. 17, 2004 (JP) ..... 2004-039431

(51) Int. Cl.
*F01L 1/34* (2006.01)

(52) U.S. Cl. ..... 123/90.16; 123/90.2; 123/90.44

(58) Field of Classification Search ..... 123/90.16, 123/90.2, 90.39, 90.41, 90.44, 90.6; 74/559, 74/567, 569

See application file for complete search history.

(56) References Cited

U.S. PATENT DOCUMENTS

| | | | | |
|---|---|---|---|---|
| 6,311,659 | B1 | 11/2001 | Pierik | |
| 6,499,454 | B2 * | 12/2002 | Miyazato et al. | 123/90.31 |
| 6,694,935 | B2 * | 2/2004 | Miyazato et al. | 123/90.16 |
| 2003/0226531 | A1 | 12/2003 | Miyazato et al. | |

FOREIGN PATENT DOCUMENTS

| | | | |
|---|---|---|---|
| DE | 33 30 141 | A1 | 3/1985 |
| DE | 101 35 201 | A1 | 2/2002 |
| DE | 103 25 749 | A1 | 1/2004 |
| DE | 699 21 153 | T2 | 3/2005 |
| EP | 1 255 025 | A2 | 11/2002 |
| JP | 2003-500602 | A | 1/2003 |
| WO | WO 00/73636 | A1 | 12/2000 |

OTHER PUBLICATIONS

Schnitzlein et al., :"Lexikon Kraftfahzeugtechnik," 3rd Edition, VEB Verlag Technik, Berlin, 1976, p. 222.

* cited by examiner

*Primary Examiner*—Ching Chang
(74) *Attorney, Agent, or Firm*—Foley & Lardner LLP

(57) ABSTRACT

A valve operating mechanism of an internal combustion engine, comprises a drive cam rotatable with and eccentric to a drive shaft; a link arm having a circular opening in which the drive cam is rotatably received, so that rotation of drive cam about an axis of the drive shaft produces a swing movement of the link arm; a pair of swing cams swingably disposed on the drive shaft at both sides of the drive cam, the swing cams being connected through a movement transmission mechanism to the link arm to be swung when the link arm is subjected to the swing movement; a pair of swing arms respectively actuated by the swing cams for carrying out an open/close operation of a pair of engine valves; a pair of spring retainers respectively provided by the pair of engine valves; and a pair of valve springs respectively held by the spring retainers and biasing the engine valves in a close direction. A lubricating oil passage is formed in the drive cam. The oil passage has one end exposed to an oil feeding passage formed in the drive shaft and the other end exposed to a minute clearance defined between a cylindrical outer surface of the drive cam and a cylindrical inner surface of the circular opening of the link arm.

28 Claims, 20 Drawing Sheets

VALVE OPERATING MECHANISM OF INTERNAL COMBUSTION ENGINE

BACKGROUND OF THE INVENTION

1. Field of the Invention

The present invention relates in general to valve operating mechanisms of internal combustion engines, and more particularly to the valve operating mechanisms of a type having an improved lubricating oil supply arrangement that provides mutually contacting portions of moving parts with a sufficient lubricating oil.

2. Description of the Related Art

In order to clarify the task of the present invention, one conventional valve operating mechanism of an internal combustion engine will be briefly described before describing the detail of the present invention. The valve operating mechanism is disclosed in P2003-500602A (WO00/073635).

The valve operating mechanism of the publication is of a so-called "desmodromic cam driven variable valve (VVT)" type which comprises generally a camshaft that is driven by a crankshaft, valve opening and closing cams that are mounted on the camshaft and a control member that is positioned apart from the camshaft and has a supporting shaft. A rocker arm is swingably disposed on the supporting shaft and includes first and second arm portions that extend radially outward. The first arm portion is equipped at a middle part thereof with a first roller that contacts the valve opening cam and the second arm portion is equipped at a leading end thereof with a second roller that contacts the valve closing cam. Due to employment of the arrangement wherein the contact of the first roller with the valve opening cam and the contact of the second roller with the valve closing cam are constantly kept, swing movement of the rocker arm is actively carried out. Thus, in the desmodromic cam driven variable valve mechanism, there is no need of using a return spring that is usually employed in a conventional cam driven variable valve mechanism for enforcedly returning the rocker arm to a valve closing position.

To the camshaft, there are rotatably disposed a pair of swing cams that carry out an open/close movement of two intake valves through respective swing arms. Each swing arm has one end supported by a pivot member and the other end to which an end of a valve stem contacts.

SUMMARY OF THE INVENTION

Under operation of the engine, various moving parts of the valve operating mechanism are subjected to a high speed movement or rotation while being supplied with a lubricating oil. If the oil supply to such moving parts is not suitably carried out, smoothed operation of the moving parts is not effected and furthermore, the parts are subjected to a severe frictional wear which would shorten the life of the valve operating mechanism.

It is therefore an object of the present invention to provide a valve operating mechanism of an internal combustion engine, which is free of the above-mentioned drawback.

It is another object of the present invention to provide a valve operating mechanism of an internal combustion engine, which is equipped with a lubricating oil supply arrangement that provides moving parts of the mechanism, particularly mutually contacting portions of the moving parts with a sufficient amount of lubricating oil under operation of the engine.

It is still another object of the present invention to provide a desmodromic cam driven variable valve mechanism of an internal combustion engine, which is equipped with an improved lubricating oil supply arrangement that provides moving parts of the mechanism with a sufficient amount of lubricating oil under operation of the engine.

In accordance with a first aspect of the present invention, there is provided a valve operating mechanism of an internal combustion engine, which comprises a drive cam rotatable with and eccentric to a drive shaft; a link arm having a circular opening in which the drive cam is rotatably received, so that rotation of drive cam about an axis of the drive shaft produces a swing movement of the link arm; a pair of swing cams swingably disposed on the drive shaft at both sides of the drive cam, the swing cams being connected through a movement transmission mechanism to the link arm to be swung when the link arm is subjected to the swing movement; a pair of swing arms respectively actuated by the swing cams for carrying out an open/close operation of a pair of engine valves; a pair of spring retainers respectively provided by the pair of engine valves; a pair of valve springs respectively held by the spring retainers and biasing the engine valves in a close direction; and an oil passage formed in the drive cam, the oil passage having one end exposed to an oil feeding passage formed in the drive shaft and the other end exposed to a minute clearance defined between a cylindrical outer surface of the drive cam and a cylindrical inner surface of the circular opening of the link arm.

In accordance with a second aspect of the present invention, there is provided a valve operating mechanism of an internal combustion engine, which comprises a drive cam rotatable with and eccentric to a drive shaft; a link arm having a circular opening in which the drive cam is rotatably received, so that rotation of the drive cam about an axis of the drive shaft produces a swing movement of the link arm; a pair of swing cams swingably disposed on the drive shaft at both sides of the drive cam, the swing cams being linked to the link arm to be swung when the link arm is subjected to the swing movement; a pair of swing arms respectively actuated by the swing cams for carrying out an open/close operation of a pair of engine valves; a pair of spring retainers respectively provided by the pair of engine valves; a pair of valve springs respectively held by the spring retainers and biasing the engine valves in a close direction; and a lubricating oil supply arrangement comprising a minute clearance defined between a cylindrical outer surface of the drive cam and a cylindrical inner surface of the circular opening of the link arm; and oil holding spaces provided at axially both ends of the minute clearance, the holding spaces being positioned above the spring retainers and the valve springs, so that, under operation of the engine, the lubricating oil in the oil holding spaces is permitted to fall onto the spring retainers and the valve springs due to a gravity applied to the lubricating oil.

In accordance with a third aspect of the present invention, there is provided a valve operating mechanism of an internal combustion engine, which comprises a drive cam rotatable with and eccentric to a drive shaft; a link arm having a circular opening in which the drive cam is rotatably received, so that rotation of drive cam about an axis of the drive shaft produces a swing movement of link arm; a pair of swing cams swingably disposed on the drive shaft at both sides of the drive cam, the swing cams being linked to the link arm to be swung when the link arm is subjected to the swing movement; a pair of swing arms respectively actuated by the swing cams for carrying out an open/close operation of a pair of engine valves; a pair of spring retainers respectively provided by the pair of engine valves; a pair of valve springs respectively held by the spring retainers and biasing the engine valves in a close direction; and a lubricating oil supply arrangement including a minute clearance defined between a cylindrical outer surface of the drive cam and a cylindrical inner surface of the circular opening of the link arm; oil holding spaces provided at axially both ends of the minute clearance to temporarily hold therein a lubricating oil coming out from the minute clearance; and an oil throwing means that enforcedly throws the lubricating oil in the oil holding spaces toward given portions of the spring retainers and the valve springs, the given portions being upper surfaces of the spring retainers and the valve springs with respect to a gravitational direction.

In accordance with a fourth aspect of the present invention, there is provided a valve operating mechanism of an internal combustion engine, which comprises a drive cam rotatable with and eccentric to a drive shaft, the drive cam having a cylindrical outer surface to which a lubricating oil is applied; a pair of swing cams to carry out an open/close operation of a pair of engine valves when swung; a movement transmission mechanism that converts a rotary motion of the drive cam to a swing motion of the pair of swing cams; and a lubricating oil receiving member that is movable together with the engine valves, at least a part of the lubricating oil receiving member being arranged in a projected width of the drive cam.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
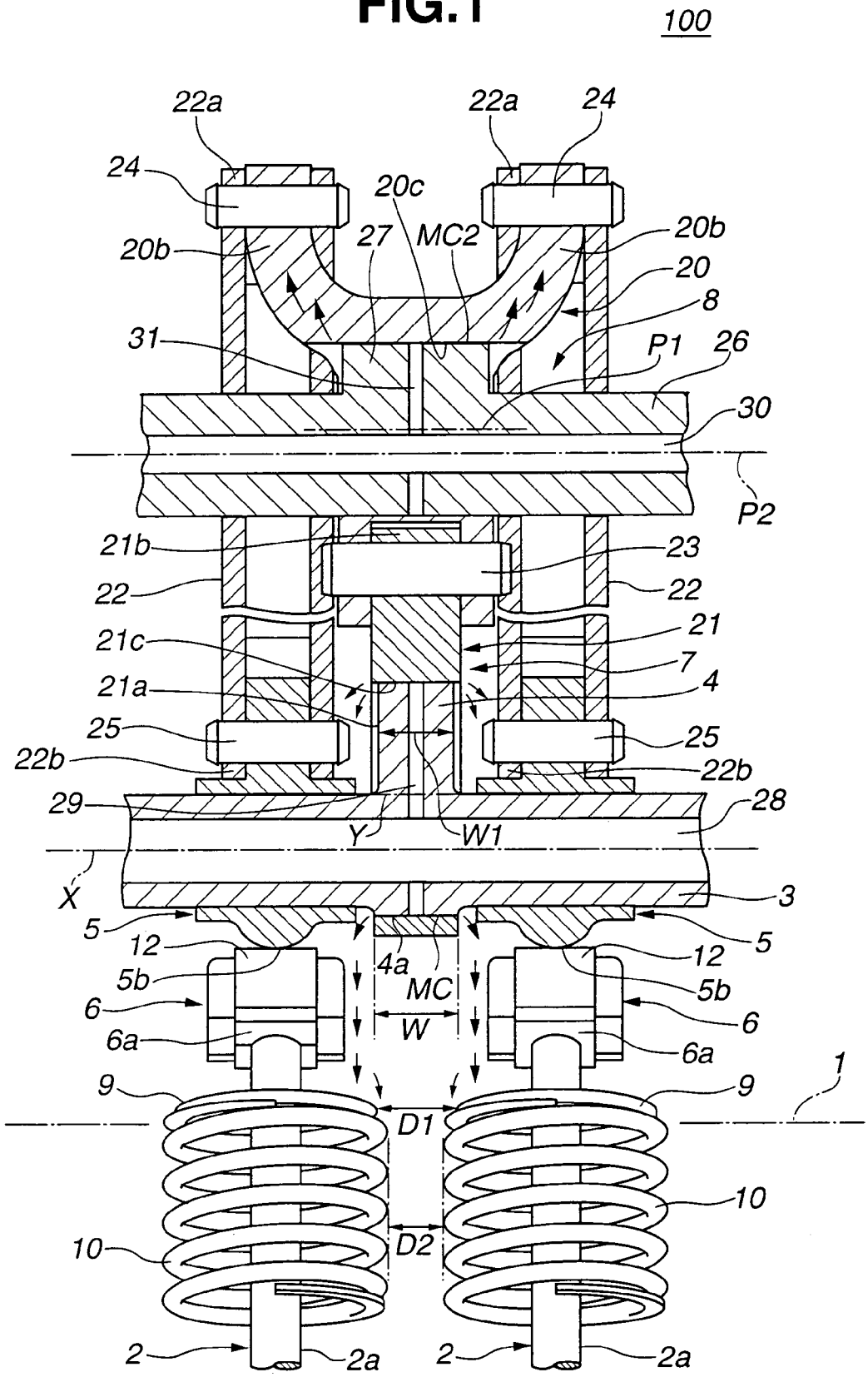
FIG. 1 is a sectional view of a valve operating mechanism of a first embodiment of the present invention.

In the following, various embodiments 100, 200, 300, 400, 500 and 600 of the present invention will be described in detail with reference to the accompanying drawings.

For ease of understanding, various direction terms, such as, right, left, upper, lower, rightward and the like are used in the following description. However, such terms are to be understood with respect to only the drawing on which the corresponding part or portion is shown.

It is to be noted that the valve operating mechanism 100, 200, 300, 400, 500 or 600 of the embodiment is constructed to be applicable to multicylinder internal combustion engines of a type having two intake valves for each cylinder and has a function to vary a lift degree of each intake valve in accordance with an operation condition of the engine.

Referring to FIGS. 1 to 11, particularly FIGS. 1 to 5, there is shown a valve operating mechanism 100 of an internal combustion engine, which is a first embodiment of the present invention.

Figure 2:
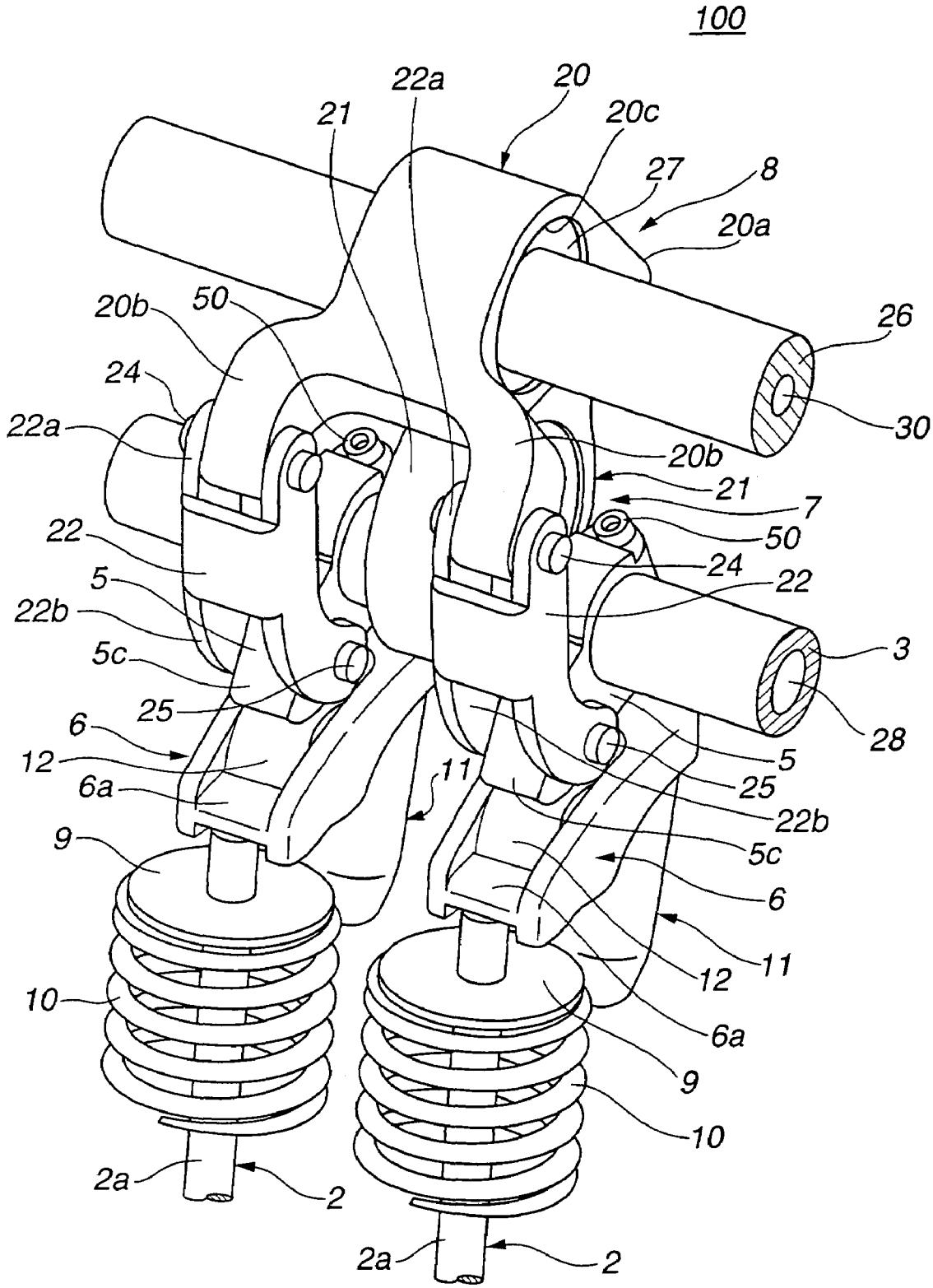
FIG. 2 is a perspective view of the valve operating mechanism of the first embodiment, showing a front side of the valve operating mechanism.
Figure 3:
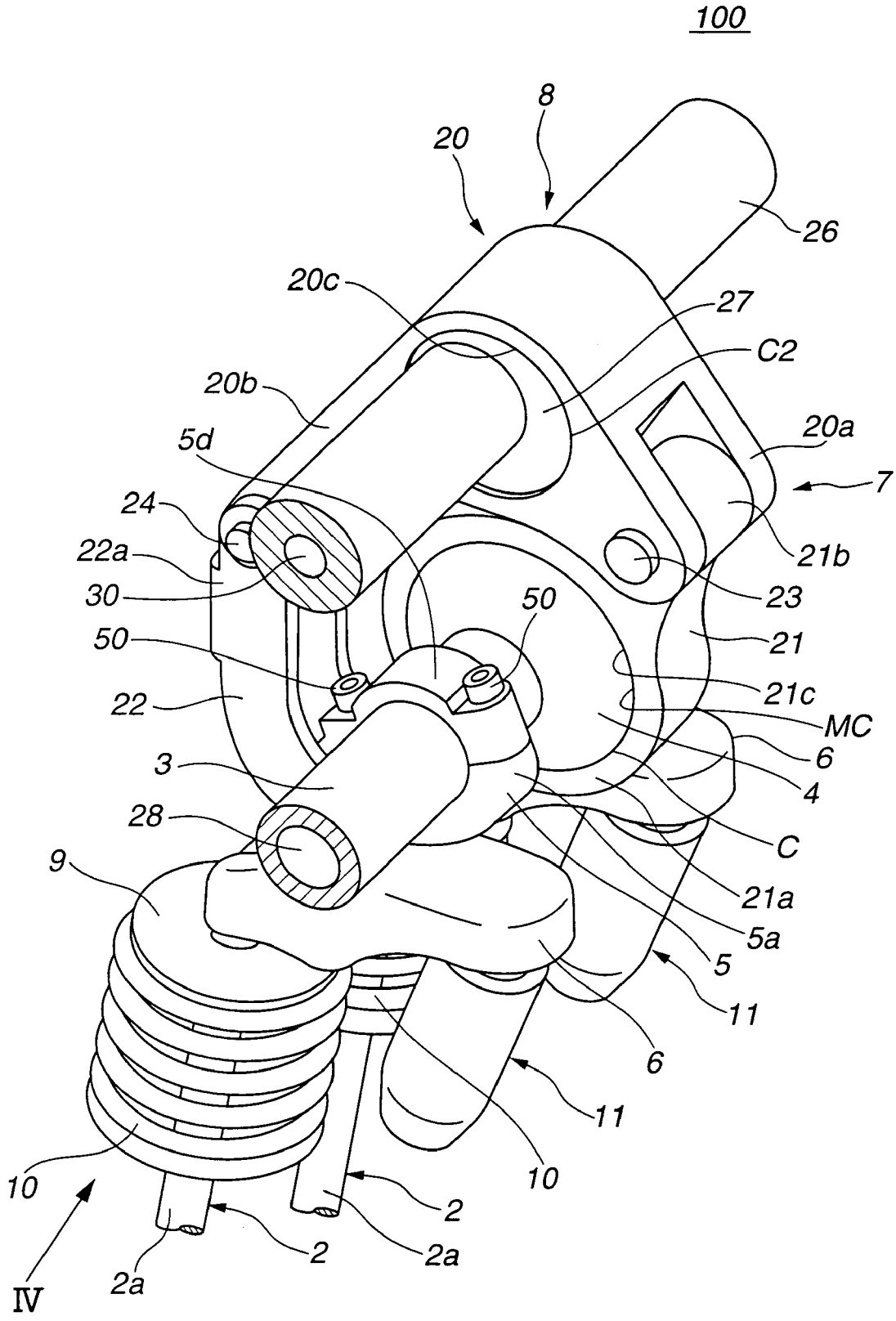
FIG. 3 is a perspective view of the valve operating mechanism of the first embodiment, but showing a rear side of the valve operating mechanism.

As is best seen from FIGS. 1, 2 and 3, valve operating mechanism 100 of this first embodiment is constructed to control a pair of intake valves 2 and 2 (viz., engine valves) of an internal combustion engine. Intake valves 2 and 2 are slidably held by a cylinder head 1 of the engine through valve guides (not shown).

Positioned above intake valves 2 and 2 is a hollow drive shaft 3 that is a part of the valve operating mechanism 100 and extends in an axial direction of the engine.

As is seen from FIG. 1, a drive cam 4 is integrally formed on drive shaft 3 at a portion just above the corresponding cylinder.

A pair of swing cams 5 and 5 are rotatably held by drive shaft 3 at axially opposite positions of the shaft 3 relative to drive cam 4. These swing cams 5 and 5 function to cause intake valves 2 and 2 to make their open/close movement through respective swing arms 6 and 6.

As is understood from FIGS. 1, 2 and 3, a so-called movement transmission mechanism 7 is arranged between drive cam 4 and each of swing cams 5 and 5 to transmit the torque of the drive cam 4 to swing cams 5 and 5. Actually, due to the construction of the mechanism 7, the rotary motion of drive cam 4 is converted to a swing motion of swing cams 5 and 5.

As is understood from FIGS. 1, 2 and 3, a so-called valve lift control mechanism 8 is arranged to control a lift degree of intake valves 2 and 2. Actually, valve lift control mechanism 8 operates to vary an operational position of movement transmission mechanism 7.

As is best understood from FIG. 2, each intake valve 2 comprises a valve stem 2*a* that has a circular spring retainer 9 fixed to an upper portion thereof through a cotter (not shown). A coiled valve spring 10 is compressed between spring retainer 9 and a bottom of a circular bore (not shown) formed in cylinder head 1 (see FIG. 1), so that intake valve 2 is biased in a direction to take a close position. In other words, when valve stem 2*a* is pressed down against the biasing force of valve spring 10, the corresponding intake valve 2 is forced to assume its open position.

Each spring retainer 9 and each valve spring 10 serve as an oil receiving means that receives a lubricating oil that would drop from drive cam 4 and its surrounding parts under operation of the engine.

As shown, a diameter of spring retainer 9 is somewhat smaller than an outer diameter of valve spring 10.

Drive shaft 3 that extends in the axial direction of the engine is rotatably held by a plurality of bearings (not shown) mounted on cylinder head 1.

Although not shown in the drawings, a sprocket is connected to one end of drive shaft 3, and a timing chain driven by a crankshaft of the engine is put around the sprocket. Thus, under operation of the engine, the rotation force of the crankshaft is transmitted to drive shaft 3 to rotate the same. Usually, a so-called phase control mechanism is arranged between the sprocket and drive shaft 3 to vary an operation timing (or phase) of drive shaft 3 relative to crankshaft.

Figure 4:
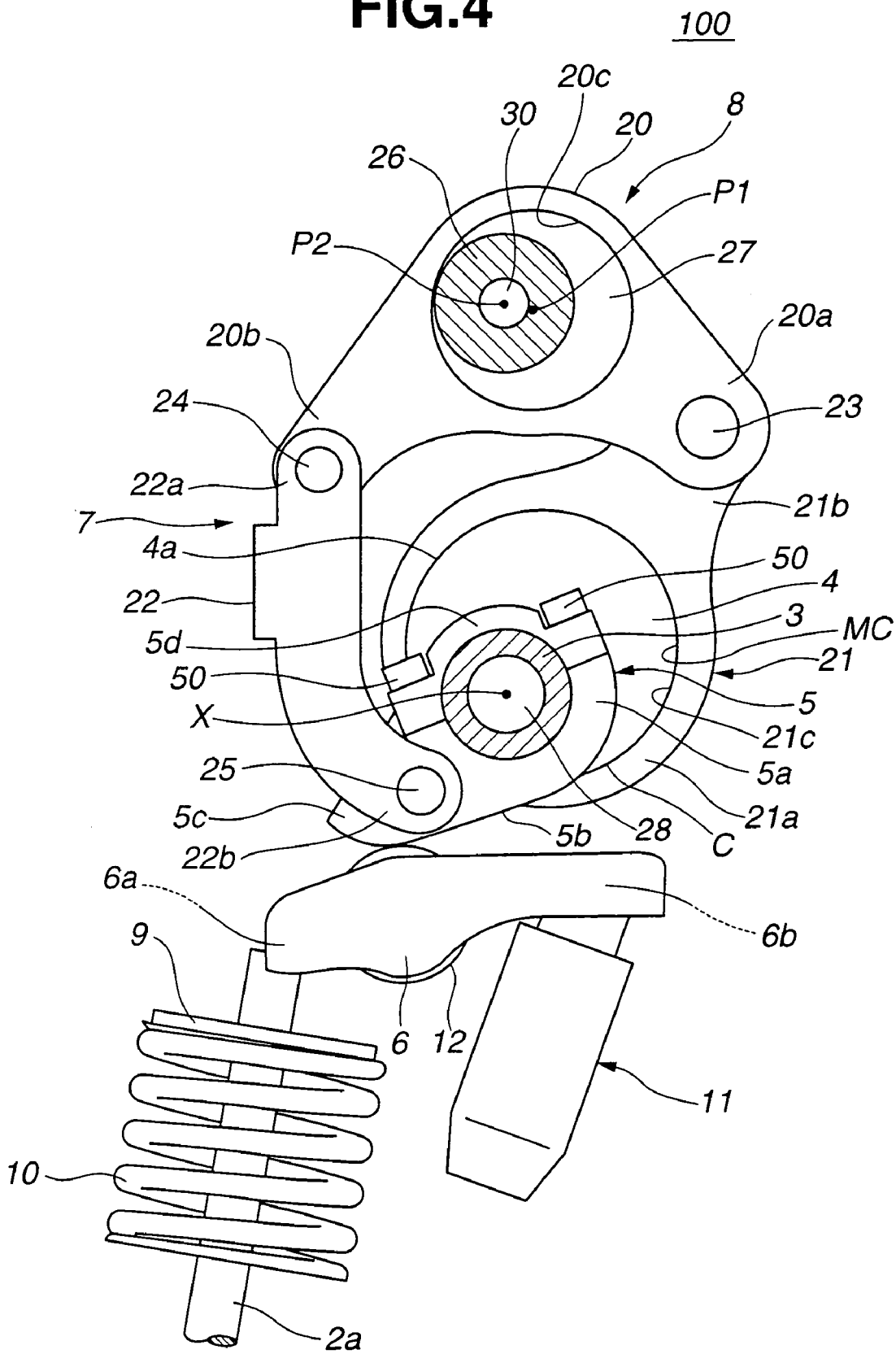
FIG. 4 is a sectional view of the valve operating mechanism of the first embedment, that is a view taken from a direction of the arrow "IV" of FIG. 3.

As is seen from FIG. 4, drive cam 4 is circular in shape and prepared for each cylinder of the engine. However, as is understood from FIG. 4 and FIG. 1, a center "Y" of circular drive cam 4 differs from an axis "X" of drive shaft 3, so that drive cam 4 has an eccentric cam profile on its outer surface 4*a* relative to drive shaft 3.

As is understood from FIGS. 2 and 4, the pared swing cams 5 and 5 are identical in shape and have each a raindrop-shaped cross section. Each swing cam 5 has a larger base portion 5*a* that is rotatably disposed on drive shaft 3.

As is seen from FIG. 4, each swing cam 5 has on its lower side a semicircular cam surface 5*b* that extends from larger base portion 5*a* toward a cam nose portion 5*c*. As will become apparent as the description proceeds, when larger base portion 5*a* contacts an after-mentioned roller 12 held by an after-mentioned swing arm 6, the corresponding intake valve 2 exhibits a minimum lift degree, while, when cam nose portion 5*c* contacts the roller 12, the intake valve 2 exhibits a maximum lift degree.

As is seen from FIGS. 3 and 4, base portion 5*a* of each swing cam 5 is rotatably connected to drive shaft 3 with the aid of a cap 5*d* that is secured to base portion 5*a* by two bolts 50 and 50. That is, when joined together, base portion 5*a* and cap 5*d* constitute therebetween a circular bore in which drive shaft 3 is slidably rotatable.

Figure 6:
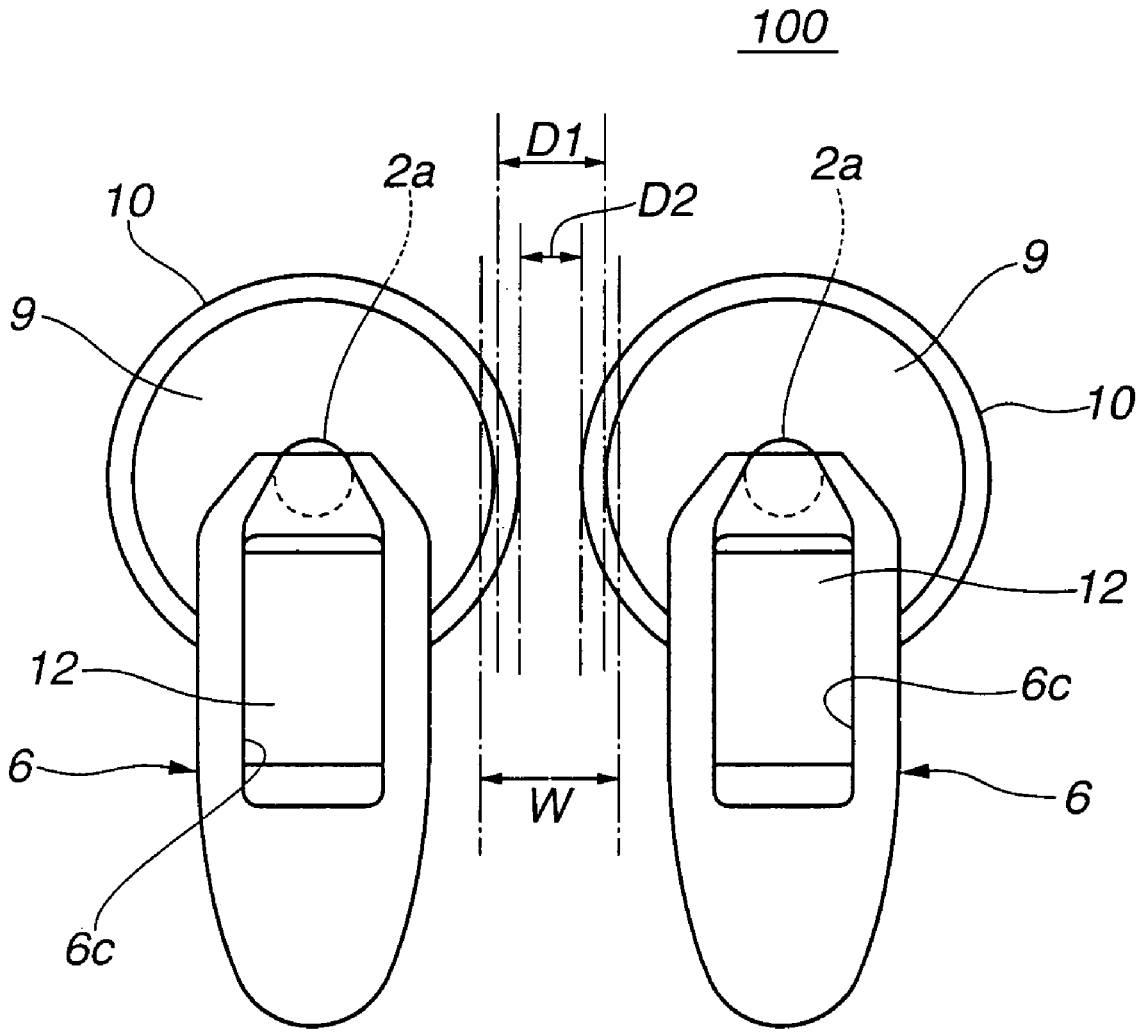
FIG. 6 is a partial plan view showing swing arms, spring retainers and valve springs that are employed in the valve operating mechanism of the first embodiment.
Figure 7A:
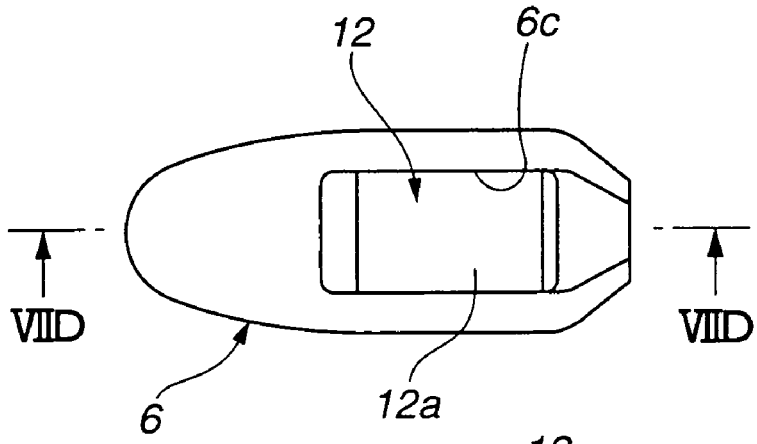
FIGS. 7A, 7B, 7C and 7D are respectively plan, side, bottom and sectional views of the swing arm, the sectional view, viz., FIG. 7D, being taken along the line VIID-VIID of FIG. 7A.
Figure 7B:
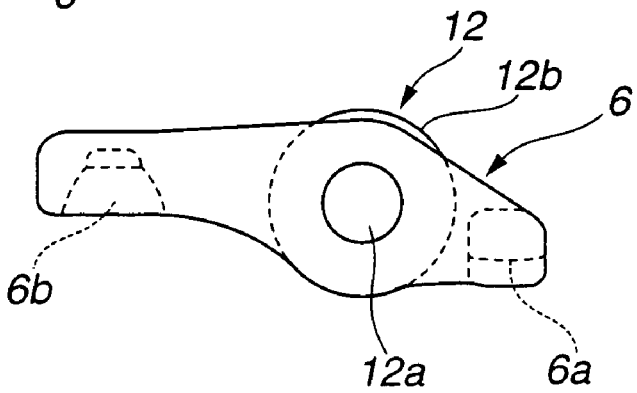
Figure 7C:
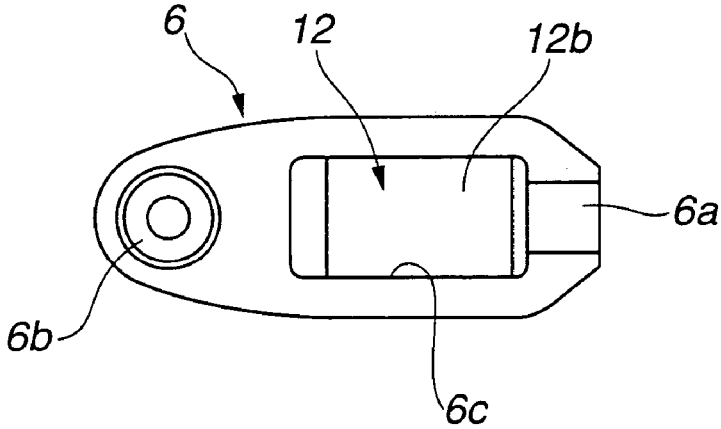
Figure 7D:
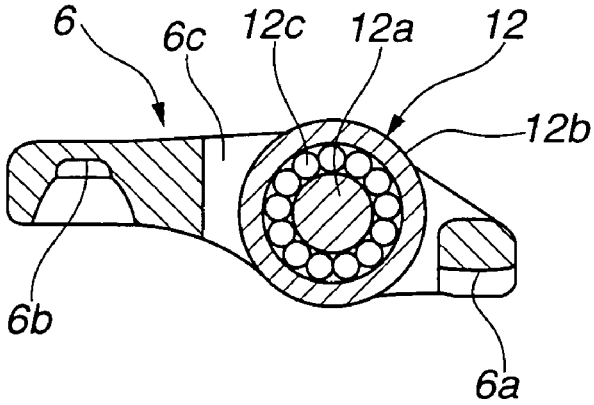

As is seen from FIG. 6 and FIGS. 7A to 7D, each swing arm 6 is shaped like a bell-crank and comprises, as is seen from FIG. 7D, a shorter arm (no numeral) that has at its leading end a contact portion 6*a* to which a top of valve stem 2*a* of the corresponding intake valve 2 contacts, and a longer arm (no numeral) that has at its leading end a conical recess 6*b* to a concave inner wall of which a pivot member 11 (see FIG. 4) that serves as a fulcrum contacts.

As is seen from FIGS. 7C and 7D, swing arm 6 is formed at a generally middle portion thereof with a rectangular through bore 6*c* that extends vertically in FIG. 4. As is seen from FIGS. 7B, 7C and 7D, within rectangular bore 6*c*, there is rotatably disposed a roller 12.

As is best seen from FIG. 7D, roller 12 is rotatably supported by a supporting shaft 12*a* that has both ends fixed to opposed walls of rectangular bore 6*c*. Roller 12 comprises an annular roller member 12*b* that is concentrically disposed about supporting shaft 12*a*, and two ball bearings 12*c* and 12*c* that are arranged at axially both sides of annular roller member 12*b* and operatively disposed between supporting shaft 12*a* and annular roller member 12*b*. As shown, each ball bearing 12*c* comprises a plurality of balls that are circularly arranged.

Figure 8:
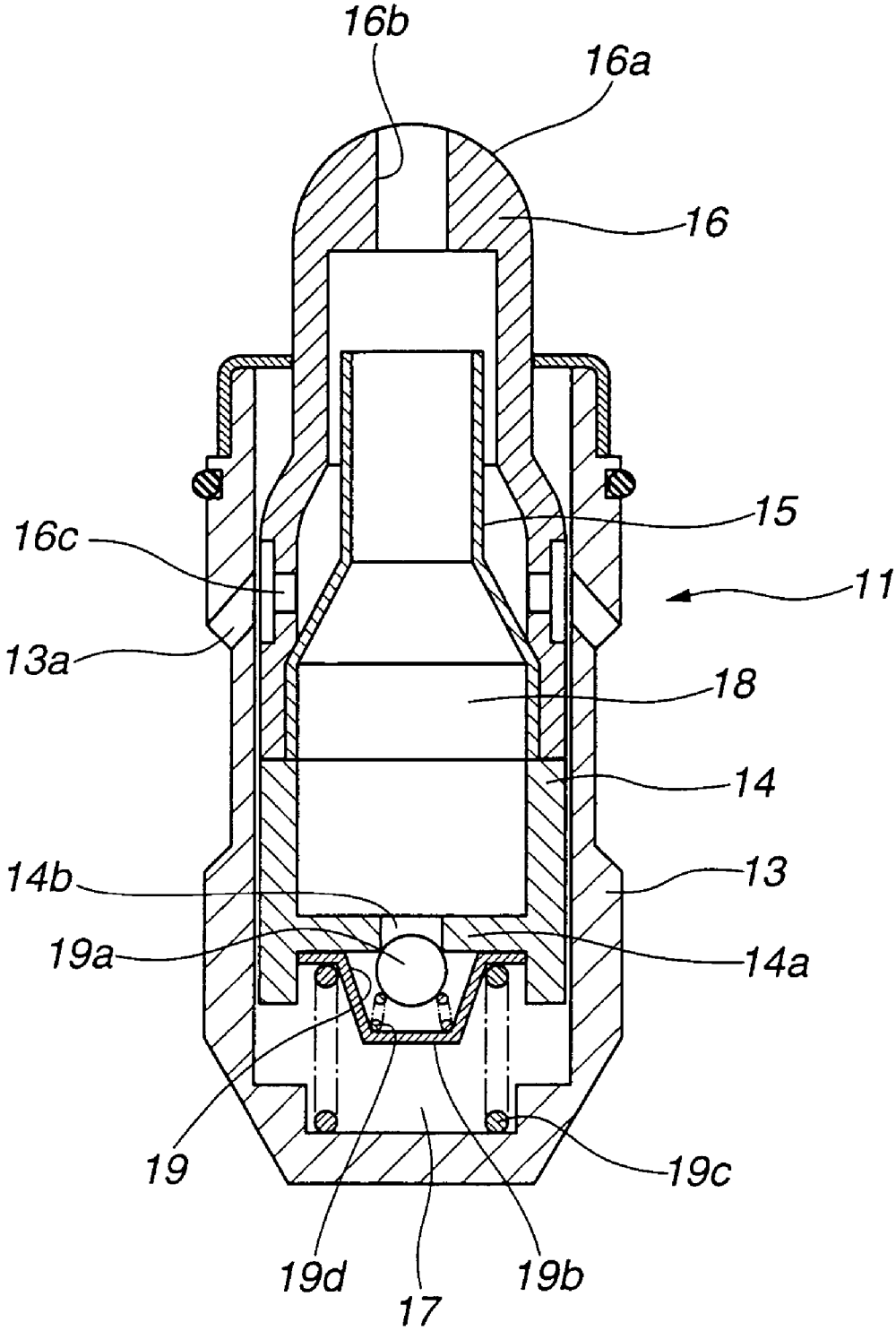
FIG. 8 is a sectional view of a hydraulic lash adjuster employed in the valve operating mechanism of the first embodiment.
Figure 9B:
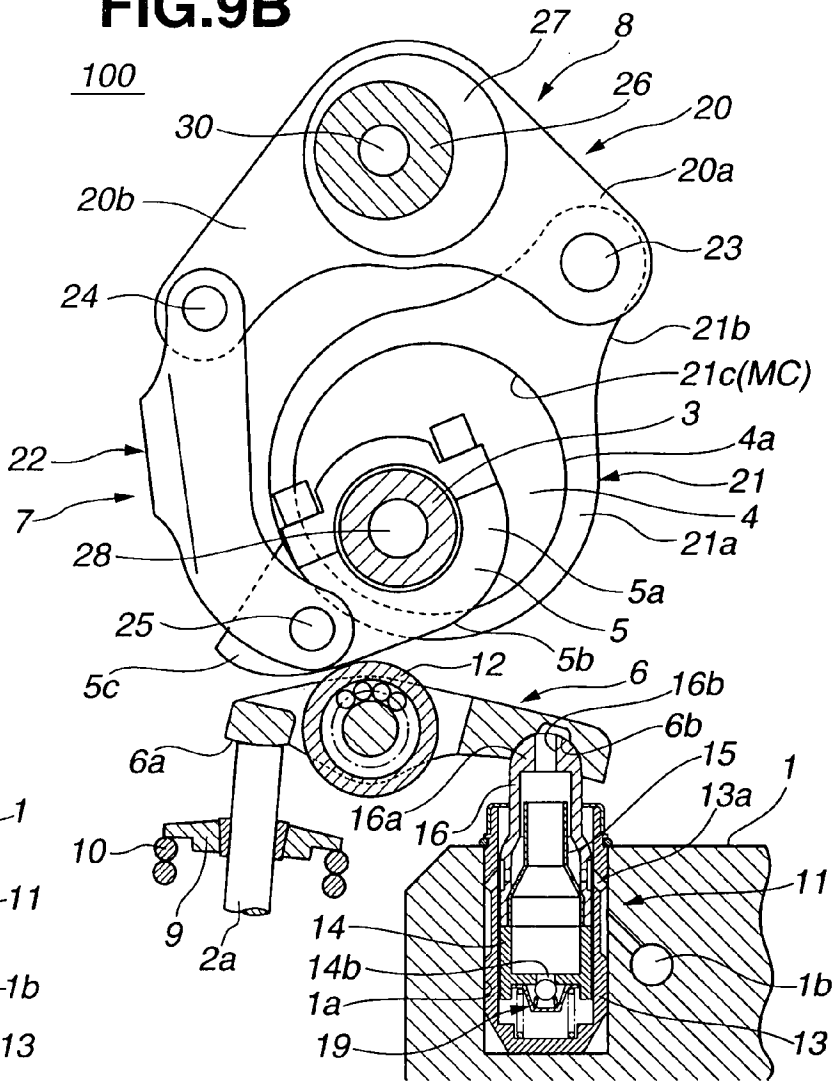
FIGS. 9A and 9B are sectional views of the valve operating mechanism of the first embodiment, showing respectively a closing operation of an intake valve under a low lift control, and an opening operation of the intake valve under the low lift control.
Figure 9A:
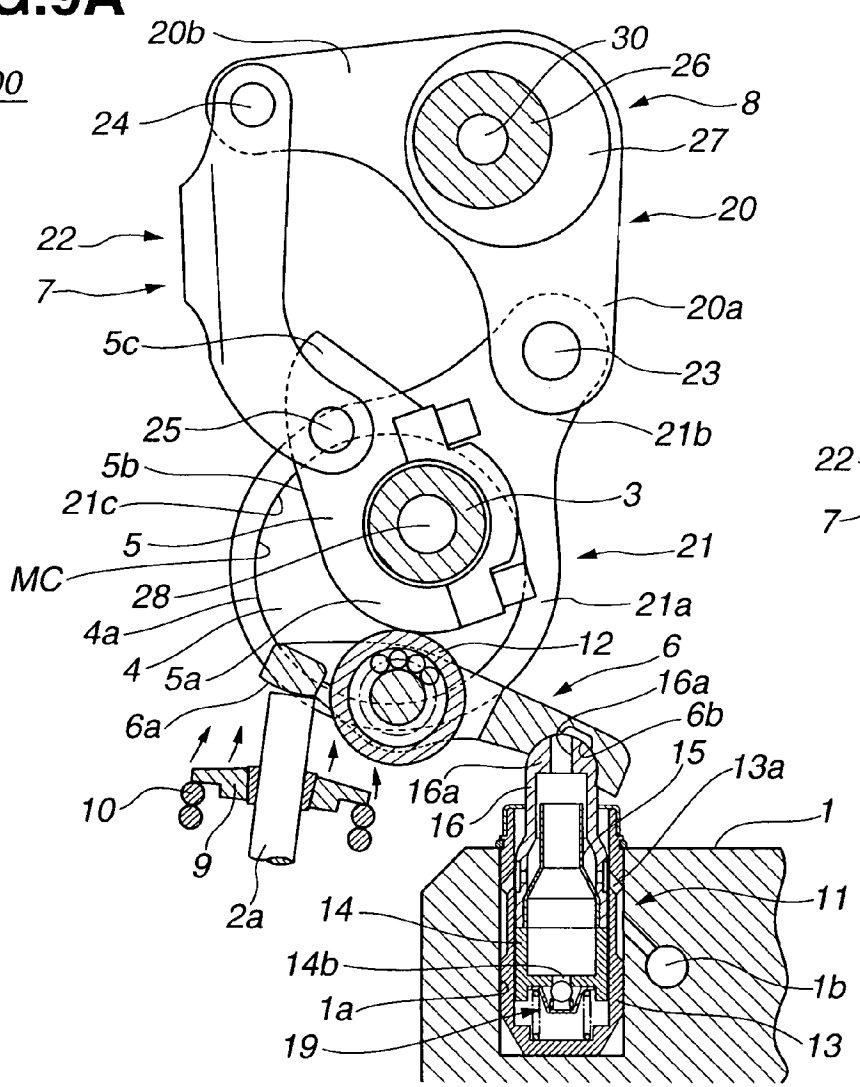

As is seen from FIGS. 8 and 9A, each pivot member 11 is of a hydraulic lash adjusting type and comprises a cylindrical bottomed body 13 that is tightly received in a holding recess 1*a* formed in the upper part of cylinder head 1 of the engine, a cylindrical retainer 14 that is received in a lower portion of the body 13, an air separating cylindrical portion 15 that is mounted on cylindrical retainer 14, and a plunger 16 that is slidably received in the body 13 with its upper domed head 16*a* projected upward. Upon assembly, the domed head 16*a* contacts the concave inner wall of conical recess 6*b* (see FIG. 7D) of swing arm 6.

As is seen from FIG. 8, cylindrical retainer 14 has a partition wall 14*a* by which a high pressure chamber 17 and a reservoir chamber 18 are separated from each other. Partition wall 14*a* is formed with an opening 14*b*. Within high pressure chamber 17, there is arranged a check valve 19 that functions to open and close opening 14*b* of partition wall 14. Check valve 19 comprises a check ball 19*a* that functions to open and close opening 14*b*, a cup-shaped spring retainer 19*b* that receives check ball 19*a*, a first coil spring 19*c* that is compressed between spring retainer 19*b* and the bottom of body 13 to bias spring retainer 19*b* toward partition wall 14*a*, and a second coil spring 19*d* that is compressed between check ball 19*a* and spring retainer 19*b* to press check ball 19*a* against the opening 14*b*, as shown.

Upper domed head 16*a* of plunger 16 is formed with an oil passage 16*b* through which a lubricating oil in reservoir chamber 18 is fed to a contact zone that is defined between an outer surface of domed head 16*a* of plunger 16 and the concave inner wall of conical recess 6*b* of swing arm 6.

As is seen from FIG. 9A, cylinder head 1 of the engine is formed with an oil passage 1*b* from which the lubricating oil is fed to reservoir chamber 18 through an opening 13*a* formed in a side wall of the body 13 and an opening 16*c* formed in a side wall of plunger 16. Under a zero-lift condition of intake valve 2 wherein no load is applied to plunger 16, the lubricating oil in reservoir chamber 18 opens the spring biased check ball 19*a*, so that the lubricating oil is permitted to flow into higher pressure chamber 17. Upon this, plunger 16 is pushed upward in FIG. 8 thereby to push the longer arm of swing arm 6 upward in FIG. 4. With this, under the zero-lift condition, a valve clearance, or the clearance between the contact portion 6*a* of the shorter arm of swing arm 6 and the upper end of valve stem 2*a* is kept zero. While, after lifting of intake valve 2 starts, check ball 19*c* is forced to take its close position, and thus, plunger 19 becomes substantially fixed relative to body 13.

As is seen from FIGS. 1 to 5, particularly FIGS. 2 and 3, movement transmission mechanism 7 comprises a rocker arm 20 that is arranged above drive shaft 3, a link arm 21 (see FIG. 3) that pivotally connects a first arm portion 20*a* of rocker arm 20 to drive cam 4, and a pair of link rods 22 and 22 (see FIG. 2) that pivotally connect two second arm portions 20*b* and 20*b* of rocker arm 20 to two swing cams 5 and 5. Thus, these rocker arm 20, link arm 21 and link rods 22 and 22 constitute a so-called multi-articulated link arrangement.

That is, as is best seen from FIG. 3, rocker arm 20 is formed at its middle base portion with a supporting bore 20*c* that receives therein an after-described control cam 27, and thus rocker arm 20 is pivotally supported by the control cam 27. First arm portion 20*a* of rocker arm 20 is formed with a recess (no numeral) that has a pin 23 held by opposed walls of the recess. Although not shown in the drawings, snap rings are connected to both ends of pin 23 to prevent dislocation of pin 23 from its proper work position.

As is seen from FIG. 2, two second arm portions 20*b* and 20*b* are defined by a fork end part of rocker arm 20 and incorporated with two swing arms 5 and 5 respectively. As shown, two second arm portions 20*b* and 20*b* are symmetrically arranged with respect to the middle base portion of rocker arm 20. Each second arm portion 20*b* has at a leading end thereof an opening (no numeral) through which a pin 24 passes. Pivotally supported by pin 24 is an upper end (or first end portion) 22*a* of link rod 22. Although not shown in the drawing, snap rings are connected to both ends of pin 24 to prevent dislocation of pin 24 from its proper work position. As is seen from the drawing, viz., FIG. 2, two second arm portions 20*b* and 20*b* of rocker arm 20 are arranged to transmit a swinging force to two swing cams 5 and 5 from a gravitational above position through link rods 22 and 22.

As is seen from FIG. 4, first arm portion 20*a* and second arm portions 20*b* and 20*b* have each a lower surface that is curved concavely.

As is understood from the same drawing, link arm 21 comprises a larger annular portion 21*a* and an arm portion 21*b* that projects radially outward from a part of annular portion 21*a*. Larger annular portion 21*a* has therein a circular opening 21*c* in which the above-mentioned drive cam 4 is intimately but rotatably received. Arm portion 21*b* is formed at its leading end with an opening (no numeral) through which the above-mentioned pin 23 passes to pivotally connect arm portion to first arm portion 20*a* of rocker arm 20.

As is seen from the drawing, viz., FIG. 4, the above-mentioned spring retainers 9 and 9 and valve springs 10 and 10 are arranged at a gravitational lower position of link arm 21.

As is seen from FIG. 1, a thickness "W" of larger annular portion 21*a* of link arm 21 is slightly larger than a thickness "W1" of drive cam 4, and as is seen from FIG. 6, the thickness "W" of larger annular portion 21*a* of link arm 21 is somewhat larger than a distance "D1" between the adjacent spring retainers 9 and 9, and larger than a distance "D2" between the adjacent valve springs 10 and 10.

It is to be noted that in the first embodiment 100 of the present invention, members that are actuated by swing cams 5 and 5 are the swing arms 6 and 6 that are relatively thin, not the conventional valve lifters that are usually bulky. This means that in the first embodiment 100, much closer arrangement is achieved by swing arms 6 and 6 as compared with the arrangement of the valve lifters. Accordingly, in the embodiment 100, the distance between two intake valves 2 and 2, and thus, the distance "D1" between the spring retainers 9 and 9, and thus, the distance "D2" between the valve springs 10 and 10 can be sufficiently reduced. As is seen from FIG. 6, these distances can be easily made smaller than the thickness "W" of larger annular portion 21*a* of link arm 21.

Referring back to FIG. 1, denoted by reference "MC" is a minute clearance that is inevitably produced under operation of the engine between the inner wall of circular opening 21*c* of link arm 21 and outer surface 4*a* of drive cam 4.

Figure 10B:
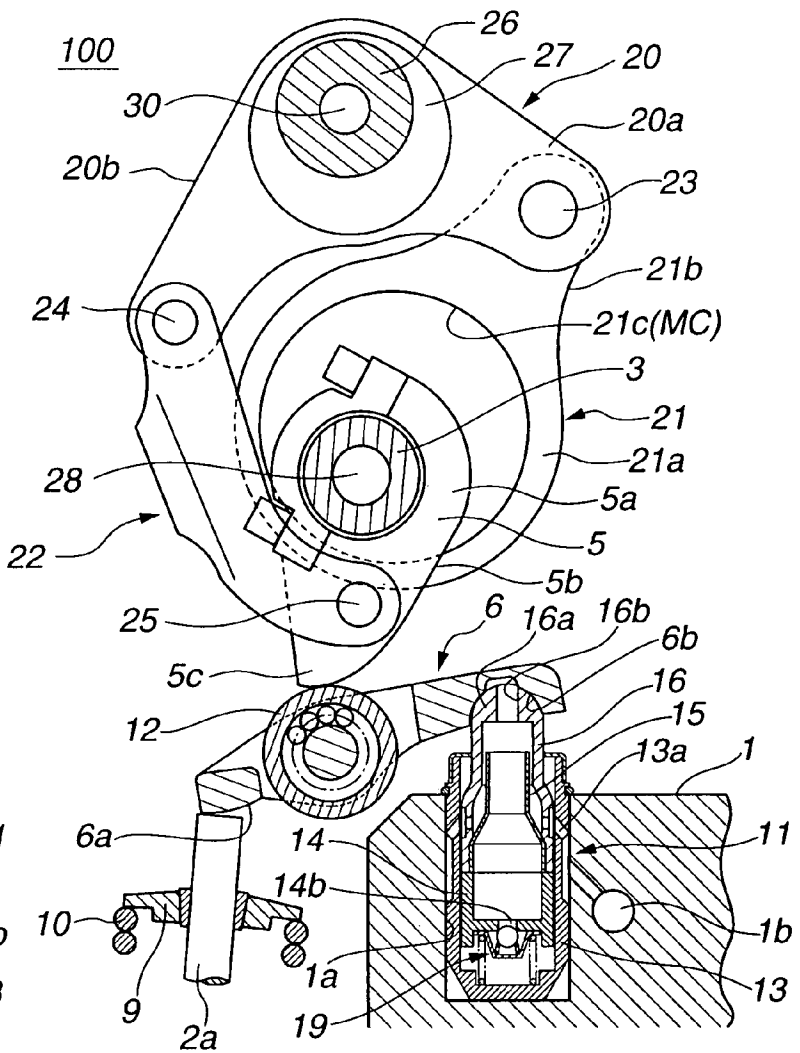
FIGS. 10A and 10B are sectional views of the valve operating mechanism of the first embodiment, showing respectively a closing operation of the intake valve under a high lift control, and an opening operation of the intake valve under the high lift control.
Figure 10A:
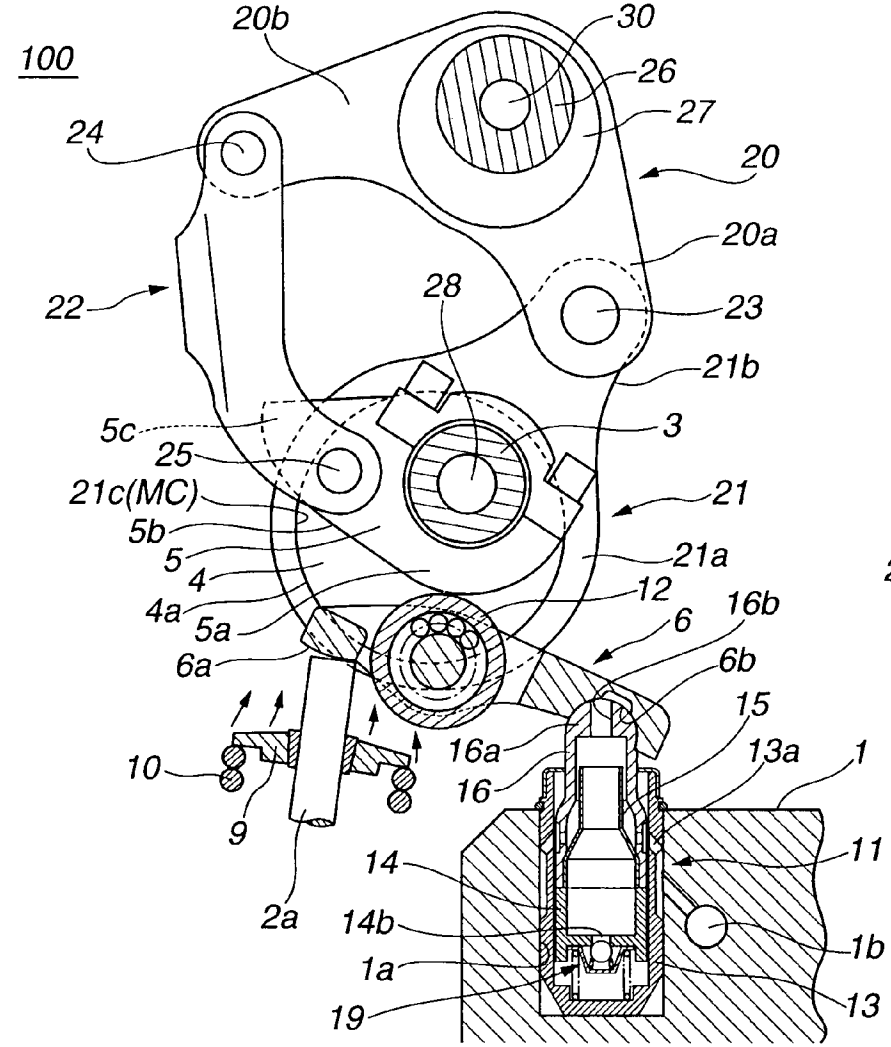

As is understood from FIGS. 9A and 10A, in the present invention, under rotation of drive cam 4, at least a part of the minute clearance "MC" is able to be positioned nearer to intake valves 2 and 2 than a contact point between swing cam 5 and roller 12 of swing arm 6 is positioned. In other words, under rotation of drive cam 4, a period is assuredly provided for which the above-mentioned positional relation between the minute clearance "MC" and the contact point assuredly takes place. In such period, feeding of the lubricating oil to the spring retainers 9 and 9 and valve springs 10 and 10 is much effectively carried out as will become apparent as the description proceeds.

As is seen from FIG. 2, each link rod 22 is shaped like a cradle, which is constructed by press-forming a metal plate. As shown in this drawing, link rod 22 comprises first and second end portions 22*a* and 22*b* each including spaced two side walls (no numerals), and a middle bridge portion (no numeral) through which first and second end portions 22*a* and 22*b* are integrally connected. First end portion 22*a* has the pin 24 by which the above-mentioned second arm portion 20*b* of rocker arm 20 is pivotally held, and second end portion 22*b* has a pin 25 by which the above-mentioned cam nose portion 5*c* of swing cam 5 is pivotally held. Actually, cam nose portion 5*c* is formed with an opening (no numeral) through which pin 25 passes. Although not shown in the drawing, snap rings are connected to both ends of pin 25 prevent dislocation of pin 25 from its proper work position.

As is seen from FIG. 3, valve lift control mechanism 8 generally comprises a control shaft 26 that is positioned above and extends in parallel with the above-mentioned drive shaft 3, and a control cam 27 that is integrally formed on control shaft 26 (see FIG. 1) and rotatably received in the above-mentioned supporting bore 20*c* of rocker arm 20. Although not shown in the drawings, control shaft 26 is rotatably held by bearing members that are provided at upper positions of the bearing members by which drive shaft 3 is rotatably held.

Although not shown in the drawings, control shaft 26 has one end that is connected through a gear mechanism to an electric actuator (viz., DC motor). That is, due to a controlled work of the electric actuator, control shaft 26 can be turned in both directions about its axis within a given angular range.

As is seen from FIG. 3, control cam 27 is cylindrical in shape and has an eccentric connection with control shaft 26, and thus, control cam 27 serves as an eccentric cam. That is, as is seen from FIG. 4, control cam 27 has an axis "P1" displaced from an axis "P2" of control shaft 26 by a given distance.

Although not shown in the drawings, the electric actuator is controlled by a controller that outputs various instruction signals by processing various information signals on an engine operation condition. Actually, the controller has a microcomputer that comprises CPU, RAM, ROM and suitable interfaces. For collecting the information signals on the engine operation condition, various sensors, such as a crank angle sensor, an air flow meter, an engine cooling water temperature sensor, a potentiometer (that detects the angular position shown by control shaft 26) and the like are used. That is, by processing such information signals, the controller issues a suitable instruction signal to the electric actuator to control the same.

As is understood from FIGS. 1 to 3, the valve operating mechanism 100 of the present invention is equipped with a lubricating oil supply arrangement to feed a lubricating oil to mutually contacting portions of the moving parts, for example, to the contacting portion between drive cam 4 and circular opening 21*c* of link arm 21, that between swing cams 5 and 5 and swing arms 6 and 6, and that between valve retainers 9 and 9 and valve springs 10 and 10.

As is best seen from FIG. 1, the lubricating oil supply arrangement comprises a first oil passage 28 that axially extends in drive shaft 3, and a branch oil passage 29 that extends diametrically in drive cam 4 and has an inner end merged with first oil passage 28 and an outer end exposed to the above-mentioned minute clearance "MC".

Thus, under operation of the engine, the lubricating oil in first oil passage 28 is forced to flow through branch oil passage 29 to the minute clearance "MC" that is defined between the inner wall of circular opening 21*c* of link arm 21 and the outer surface 4*a* of drive cam 4.

As is seen from FIG. 1, the lubricating oil supply arrangement further comprises a second oil passage 30 that axially extends in control shaft 26, and a branch oil passage 31 that extends diametrically in control cam 27 and has an inner end merged with second oil passage 30 and an outer end exposed to another minute clearance "MC2" that is defined between the inner wall of supporting bore 20*c* of rocker arm 20 and an outer surface of control cam 27. Thus, under operation of the engine, the lubricating oil in second oil passage 30 is forced to flow through branch oil passage 31 to the minute clearance "MC2" for carrying out lubrication of the contacting zone between the inner wall of supporting bore 20*c* of rocker arm 20 and the outer surface of control cam 27.

It is to be noted that the above-mentioned first and second oil passages 28 and 30 are communicated to an oil gallery (not shown) of cylinder head 1 through respective oil passages that are formed in the respective bearing members for drive and control shafts 3 and 26.

In the following, operation of valve lift control mechanism 8 will be briefly described with reference to FIGS. 9A and 9B.

Upon requirement of a lower lift control wherein intake valves 2 and 2 are controlled to have a smaller lift characteristic, the controller forces the electric actuator to turn control shaft 26 in one direction by a certain angle. With this, as is seen from FIGS. 9A and 9B, control cam 27 integral with control shaft 26 is turned in such a direction that a thickest part thereof takes a right position and kept in the newly set angular position. With such turning of control cam 27, second arm portions 20*b* and 20*b* of rocker arm 20 are lifted upward, and thus, cam nose portions 5*c* and 5*c* of respective swing cams 5 and 5 are pulled up through respective link rods 22 and 22, and thus swing cams 5 and 5 are forced to keep such positions as shown by FIGS. 9A and 9B.

Accordingly, when, due to rotation of drive cam 4, link arm 21 pushes up first arm portion 20*a* of rocker arm 20, the lifting force applied to rocker arm 20 is transmitted to swing arms 6 and 6 through link rods 22 and 22, swing cams 5 and 5 and rollers 12 and 12, as is seen from FIG. 9B.

Thus, as is understood from FIG. 9B, swing arms 6 and 6 are forced to swing downward about upper domed head 16*a* of plunger 16 pushing down respective valve stems 2*a* and 2*a* at their contact portions 6*a* and 6*a*. With such downward pushing of the valve stems 2*a* and 2*a*, the corresponding intake valves 2 and 2 are forced to open but slightly. That is, the low lift control of intake valves 2 and 2 is carried out.

While, when rocker arm 20 takes the position of FIG. 9A, swing arms 6 and 6 are forced to swing upward due to the force of valve springs 10 and 10 as is indicated by the arrows. Upon this, the corresponding intake valves 2 and 2 are forced to take their close position.

Figure 11:
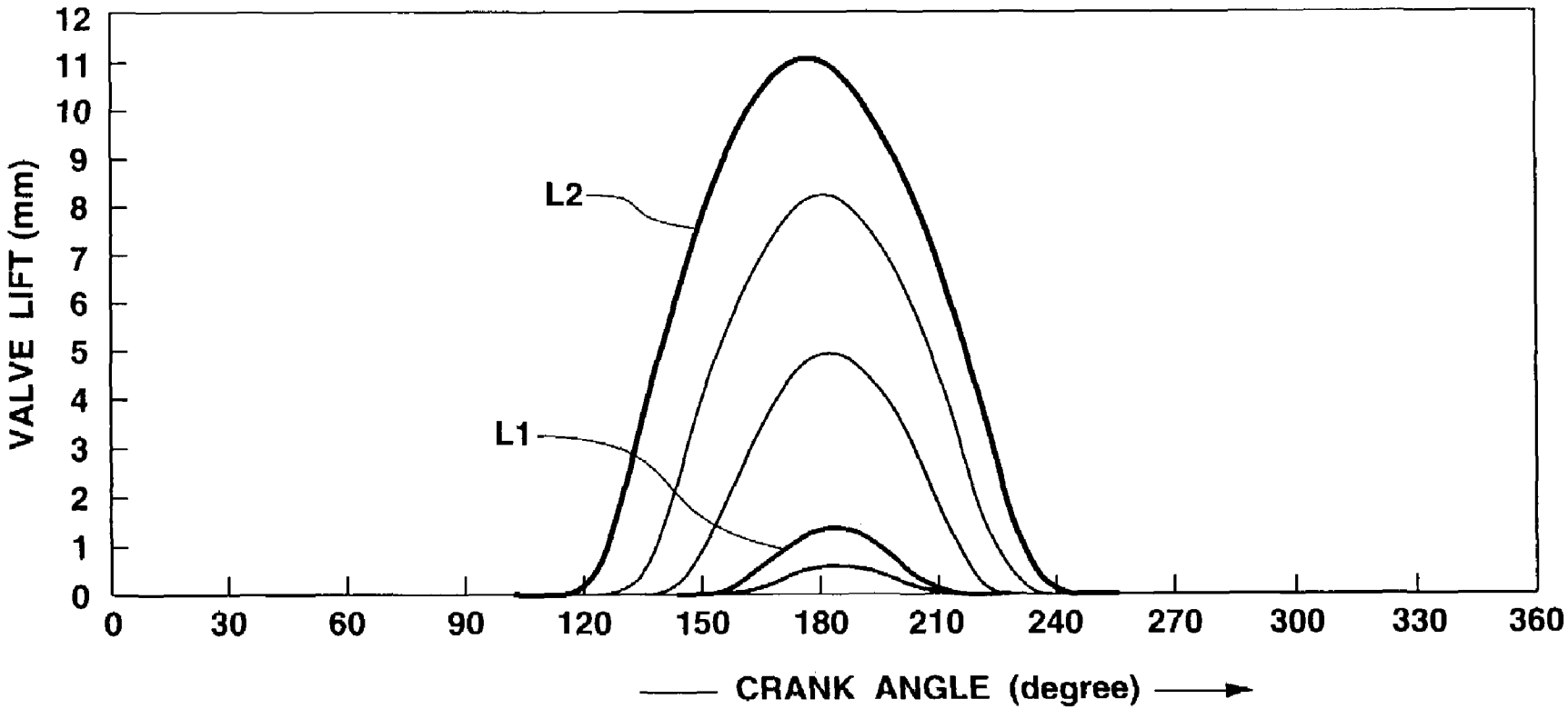
FIG. 11 is a graph showing a valve lift characteristic of an intake valve controlled by the valve operating mechanism of the first embodiment.

Such lower lift control will be much apparent from the graph of FIG. 11. Under such control, as is understood from the valve lift characteristic curve "L1", the valve lift degree is small and the valve open timing is retarded. In this case, the period for a valve overlap between intake and exhaust valves is reduced. Thus, usually, such low lift control is actually used when a stable engine operation with a certain fuel saving is needed in a low load operation of the engine.

While, upon requirement of a higher lift control wherein intake valves 2 and 2 are controlled to have a higher lift characteristic, the controller forces the electric actuator to turn control shaft 26 in the other direction by a certain angle. With this, as is seen from FIGS. 10A and 10B, control cam 27 integral with control shaft 26 is turned in such a direction that the thickest part thereof takes lower position and kept in the newly set angular position. With such turning of control cam 27, second arm portions 20*b* and 20*b* of rocker arm 20 are turned downward, and thus, cam nose portions 5*c* and 5*c* of respective swing cams 5 and 5 are pulled down through respective link rods 22 and 22, and thus, swing cams 5 and 5 are forced to keep such positions as shown by FIGS. 10A and 10B.

Accordingly, when, due to rotation of drive cam 4, link arm 21 pushes up first arm portion 20*a* of rocker arm 20, second arm portions 20*b* of rocker arm 20 push down link rods 22 and 22. With this, as is seen from FIG. 10B, swing cams 5 and 5 press the respective rollers 12 and 12 at the leading ends of cam nose portions 5*c* and 5*c* thereof, and thus, the swinging degree of swing arms 6 is increased.

Accordingly, as is understood from the valve lift characteristic curve "L2" of the graph of FIG. 11, under the higher lift control, the valve lift degree is large, the valve open timing is advanced and valve closing timing is retarded. Thus, usually, such higher lift control is actually used when a higher power with a sufficient charging efficiency is needed in a high load operation of the engine.

It is to be noted that due to the nature of valve lift control mechanism 8, the valve lift control of intake valves 2 and 2 can be continuously carried out in accordance with an operation condition of the engine, in such a manner as is depicted by the graph of FIG. 11.

In the following, operation of the lubricating oil supply arrangement will be described with reference to the drawings, particularly FIG. 1.

Under operation of the engine, a pressurized lubricating oil is fed to first oil passage 28 of drive cam 3 from an oil pump (not shown). As is understood from the drawing, the pressurized lubricating oil is led through branch oil passage 29 to the minute clearance "MC" between the inner wall of circular opening 21*c* of link arm 21 and outer surface 4*a* of drive cam 4. Thus, the slidably engaging portions of the inner wall of circular opening 21*c* and outer surface 4*a* are optimally lubricated with the lubricating oil.

Then, after carrying out the lubrication in the minute clearance "MC", the lubricating oil comes out from the minute clearance "MC" and drops down onto inside peripheral portions of spring retainers 9 and 9 and inside peripheral portions of valve springs 10 and 10, as is shown by the arrows in FIG. 1.

It is to be noted that almost all of the lubricating oil from the minute clearance "MC" can be received by the inside peripheral areas of the spring retainers 9 and 9 and those of the valve springs 10 and 10.

That is, as has been mentioned hereinabove, and as is seen from FIG. 1, the thickness "W" of larger annular portion 21*a* of link arm 21 is somewhat larger than the distance "D1" between spring retainers 9 and 9 and larger than the distance "D2" between valve springs 10 and 10, and these spring retainers 9 and 9 and valve springs 10 and 10 are positioned below the clearance "MC". These arrangements bring about the above-mentioned effective receiving of the lubricating oil by the spring retainers 9 and 9 and valve springs 10 and 10.

Under operation of the engine, due to the violent vibration of intake valves 2 and 2, the lubricating oil on spring retainers 9 and 9 and valve springs 10 and 10 is forced to fly in all directions as oil drops, and thus, the mutually contacting zone between an upper end of each valve stem 2*a* and contact portion 6*a* of the corresponding swing arm 6, that between cam surface 5*b* of each swing cam 5 and the corresponding roller 12 and that between each swing cam 5 and the corresponding link rod 22 are fed with a sufficient amount of lubricating oil, and thus, such contacting areas are sufficiently lubricated. Of course, this sufficient lubrication brings about a smoothed movement of the moving parts of the valve operating mechanism 100 without inducing undesirable frictional wear of the moving parts.

Because the thickness "W" of larger annular portion 21*a* of link arm 21 is larger than the thickness "W1" of drive cam 4, drive cam 4 is stably held in circular opening 21*c* of link arm 21 and circular steps (see FIG. 3) are inevitably produced at axially both ends of circular openings 21*c*. Due to provision of such circular steps, the lubricating oil flowing out from the minute clearance "MC" can temporarily stay at lower portions of such circular steps, and thus, a sufficient amount of lubricating oil can be effectively thrown outward by the rotating drive cam 4, which promotes the above-mentioned lubrication of the mutually contacting areas of the various parts 9 and 10.

In the first embodiment 100, the compactly arranged swing arms 6 and 6 are used in place of the conventional valve lifters, two intake valves 2 and 2 can be closely positioned, which promotes a reduction in size of the corresponding engine.

Since drive cam 4 is rotated at a high speed, the lubricating oil is thrown or splashed in a circumferential direction of drive cam 4, and thus, the rounded lower surfaces of first and second arm portions 20*a* and 20*b* of rocker arm 20 receive or hold thereon such splashed lubricating oil.

Due to the high speed swing movement of rocker arm 20, the lubricating oil on the rounded lower surfaces of the rocker arm 20 is quickly conveyed toward pins 23 and 24 to lubricate the same and then to pin 25 through link rods 22 and 22 to lubricate the same.

While, the lubricating oil fed to second oil passage 30 is led through branch oil passage 31 to the minute clearance "MC2" that is defined between the inner wall of supporting bore 20*c* of rocker arm 20 and the outer surface of control cam 27. Thus, the slidably engaging sections between supporting bore 20*c* and the control arm 27 is optimally lubricated with the lubricating oil.

Then, after carrying out the lubrication in the clearance "MC2", the lubricating oil comes out from the clearance "MC2" as is shown by the arrows in FIG. 1, and the oil flows on the outer surfaces of the two second arm portions 20*b* ad 20*b* of rocker arm 20 toward outside sections of pins 24. During this flow, as will be understood from FIG. 2, the flow of the lubricating oil is merged with the other flow of the lubricating oil that has flown on the inside and lower surfaces of the second arm portions 20*b* and 20*b* and the merged flow of the lubricating oil reaches respective pins 24 and 24 to lubricate the same.

As is easily understood from FIG. 2, after lubricating the respective pins 24 and 24, the lubricating oil flows downward on the inner surfaces of link rods 22 and 22 and reaches the lower pins 25 and 25 to lubricate the same. Since second arm portions 20*b* and 20*b* of rocker arm 20 that are pivotally held by pins 24 and 24 are positioned above pins 25 and 25, the flow of the lubricating oil toward the pins 25 and 25 is smoothly made.

Thus, the slidably engaging sections of pins 24 and 25 are adequately lubricated with the lubricating oil. Of course, this sufficient lubrication brings about a smoothed movement of the moving parts of the valve operating mechanism 100 without inducing undesirable frictional wear of the parts.

Figure 5:
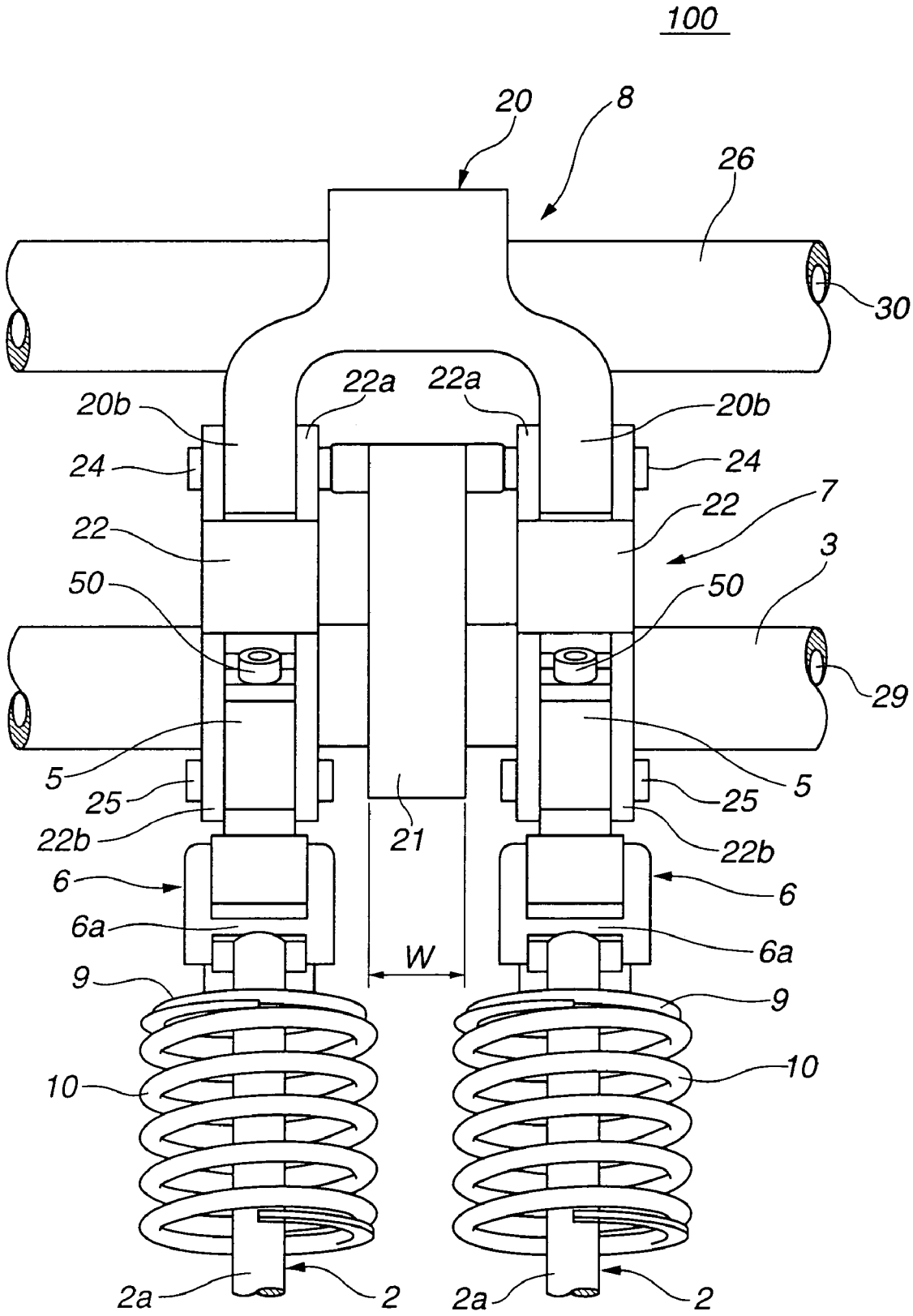
FIG. 5 is a front view of the valve operating mechanism of the first embodiment.

As is seen from FIGS. 2, 4 and 5, after lubricating the pins 25, the lubricating oil flows onto the axially opposed outer surfaces of swing cams 5 and 5 and onto cam surfaces 5*b* and 5*b* from respective cam nose portions 5*c* and 5*c*. There, the flow of the lubricating oil is mixed with the other flow of the lubricating oil that has been splashed by the vibrating spring retainers 9 and 9 and valve springs 10 and 10. The mixed flow of the lubricating oil then flows to the clearance 6*a* between cam surface 5*b* of each swing cam 5 and corresponding swing arm 6 and to the clearance between conical recess 6*b* of each swing arm 6 and domed head 16*a* of corresponding pivot member 11 for lubricating the mutually contacting portions of such moving parts.

Furthermore, under operation of the engine, the clearance between conical recess 6*b* of each swing arm 6 and domed head 16*a* of corresponding pivot member 11 is fed with the lubricating oil from reservoir chamber 18 through oil passage 16*b* (see FIGS. 8 and 9A). Due to a so-called double oil feeding function at the clearance, the mutually sliding surfaces of conical recess 6*b* and domed head 16*a* are adequately lubricated with the oil.

As is seen from FIGS. 1 and 3, the lubricating oil from minute clearance "MC2" flows onto the axially opposed outer surfaces of first arm portion 20*a* of rocker arm 20 and then to axially opposed end portions of pin 23 to lubricate the same.

As has been mentioned hereinabove, and as is seen from FIG. 4, the lower surfaces of first and second arm portions 20*a* and 20*b* of rocker arm 20 are concavely curved. This concave curvature is quite effective to receive the lubricating oil that is splashed by drive cam 4, and such concave curvature permits an easy flow of the oil toward pins 23 and 24.

In the embodiment 100, each swing cam 5 is detachably connected to drive shaft 3 by means of cap 5*d* and bolts 50 and 50. Such detachable construction of swing cam 5 facilitates the work for fixing swing cam 5 to drive shaft 3 even though drive shaft 3 has a complicated structure due to presence of drive cam 4. The integral formation of drive cam 4 on drive shaft 3 brings about not only reduction in number of parts used for the valve operating mechanism 100 but also increased mechanical strength of drive shaft 3. Thus, reduction in cost of the valve operating mechanism is obtained and irregularity or dispersion of the valve lift of each intake valve 2 is suppressed or at least minimized.

As is seen from FIGS. 1 and 2, in this embodiment 100, not only two second arm portions 20*b* and 20*b* of rocker arm 20 but also two swing cams 5 and 5 are symmetrically arranged with respect to link arm 21. This symmetric arrangement induces a finely synchronous swing movement of two swing cams 5 and 5 upon pivotal movement of link arm 21. That is, the two swing cams 5 and 5 can have a balanced swing movement and thus, undesired dispersion of the open/close operation of intake valves 2 and 2 is suppressed or at least minimized.

Between each swing cam 5 and the corresponding swing arm 6, there is arranged roller 12. Thus, the rotation of roller 12 in forward and backward directions, that is induced under the swing movement of swing cam 5, can reduce effectively a friction that would be produced in a unit that includes swing cam 5, swing arm 6 and roller 12. Due to the forward and rearward rotation of roller 12, the lubricating oil on the roller 12 can be effectively thrown to both a side where one end of swing arm 6 is exposed to the corresponding pivot member 11 (see FIG. 4) and the other side where the other end of swing arm 6 is exposed to the corresponding valve stem 2*a*. Due to this oil supply, the lubrication of the parts arranged at such sides is optimally carried out.

As is understood from FIG. 7D, each roller 12 has a cylindrical bore both ends of which are equipped with respective ball bearing structures. Thus, the cylindrical bore can serve as a temporary oil reservoir that can store a part of the lubricating oil under a rest of the engine. Thus, upon starting of the engine, the lubricating oil in the bore of each roller 12 can be thrown to near parts that surround roller 12, for example, onto the upper surface of each spring retainer 9 (see FIG. 2). Accordingly, even at a time, like the time just after starting of the engine, when a sufficient amount of lubricating oil is not supplied by the oil pump, the surrounding parts can be sufficiently lubricated by the lubricating oil from the cylindrical bores of rollers 12 and 12.

Furthermore, as is seen from FIGS. 4, 7A and 7B, rectangular bore 6*c* of each swing arm 6 in which roller 12 is rotatably held is a vertically extending through bore. Thus, during operation of the engine, the lubricating oil on the upper surface of each swing arm 6 can easily flow down through the bore 6*c* and fall down onto the corresponding spring retainer 9 (see FIG. 4). The vibration of spring retainer 9 has the lubricating oil splashed from the surface thereof toward the surrounding moving parts. Of course, a part of the splashed lubricating is fed back to the rectangular bore 6*c* and thus to the corresponding roller 12 to lubricate the same.

As has been mentioned hereinabove and as is seen from FIGS. 1, 9A and 10A, at least a part of the minute clearance "MC" inevitably produced under operation of the engine between the inner wall of circular opening 21*c* of link arm 21 and outer surface 4*a* of drive cam 4 is able to be positioned nearer to intake valves 2 and 2 than the contact point between swing cam 5 and roller 12 of swing cam 6 is positioned. Thus, the lubricating oil flowing axially from the minute clearance "MC" can be directly supplied to swing cams 5 and 5 and swing arms 6 and 6. Thus, the mutually contacting portions of these parts can be sufficiently supplied with the lubricating oil.

Furthermore, in the embodiment 100, two second arm portions 20*b* and 20*b* of rocker arm 20 and two swing cams 5 and 5 are symmetrically arranged with respect to link arm 21 and these parts 20*b*, 20*b*, 5 and 5 are synchronously operated. Thus, stable operation of such parts is obtained. That is, even in a low lift control wherein an operation irregularity tends to occur, undesired dispersion of the valve lift of each intake valve 2 can be suppressed or at least minimized.

Valve lift control mechanism 8 operates to continuously vary the valve lift degree of intake valves 2 and 2. This operation is much assured due to the symmetrical arrangement of second arm portions 20*b* and 20*b* of rocker arm 20 and that of swing cams 5 and 5. Thus, a stable lift control is constantly carried out at every lift control mode including low, high and medium lift control modes. Furthermore, even in a minute lift control mode, undesired dispersion of the lift of intake valves 2 and 2 can be suppressed or at least minimized.

Control shaft 26 of valve lift control mechanism 8 is rotatably held on cylinder head 1 through bearing members that are arranged at given intervals. That is, control shaft 26 is stably held by the bearing members, and thus, undesired slant of control shaft 26 relative to cylinder head 1 can be suppressed or at least minimized. This means that slant of rocker arm 20 and that of link arm 21 can be also suppressed or at least minimized. Thus, the valve lift control is stably made.

In the following, valve operating mechanisms of second, third, fourth, fifth and sixth embodiments 200, 300, 400, 500 and 600 of the present invention will be described with reference to the drawings.

Since the valve operating mechanisms of these second to sixth embodiments 200 to 600 are similar in construction to the valve operating mechanism 100 of the above-mentioned first embodiment, only parts or portions that are different from those of the first embodiment 100 will be described in detail for simplification of the description.

Figure 12:
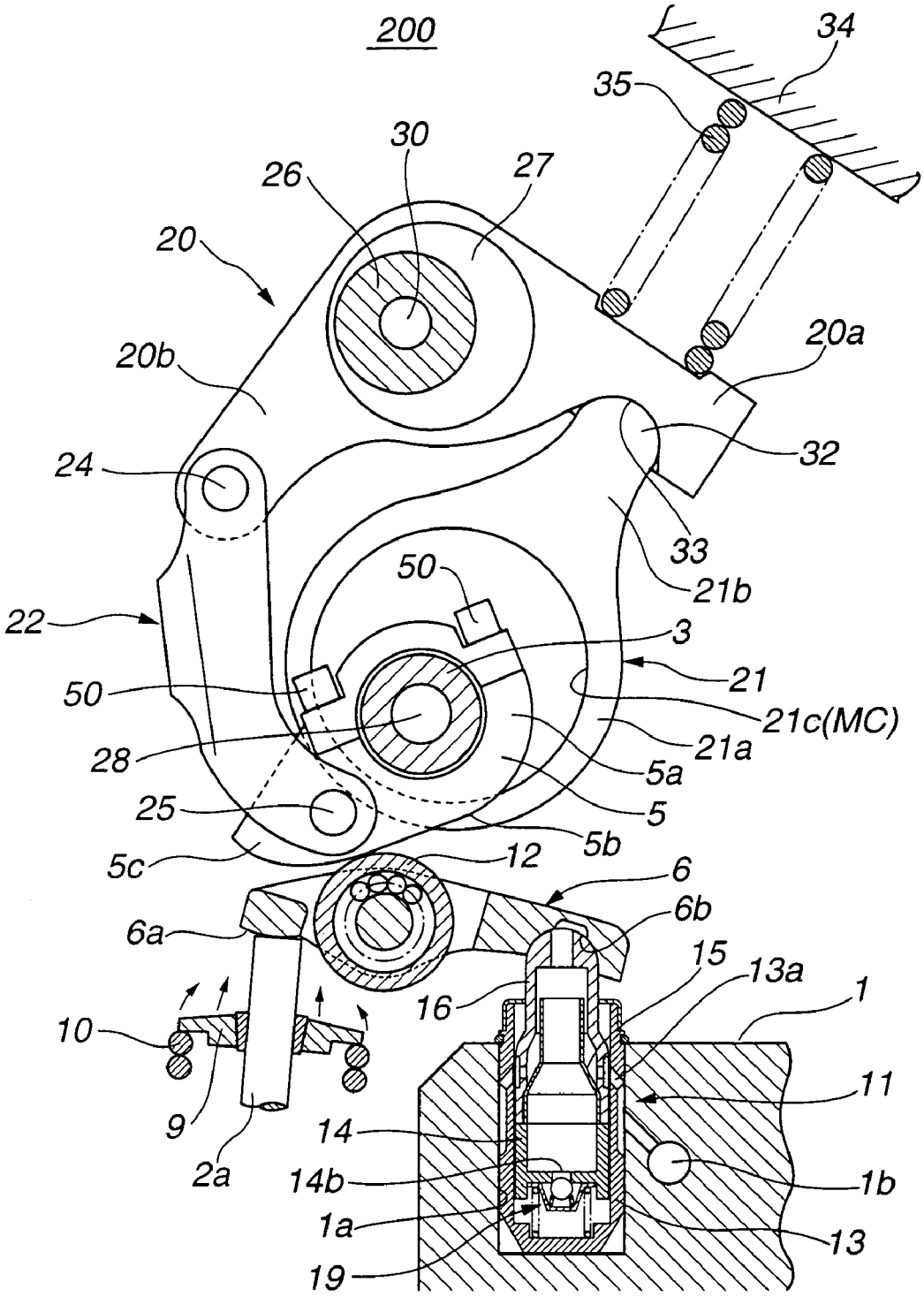
FIG. 12 is a view similar to FIG. 9A, but showing a valve operating mechanism of a second embodiment of the present invention.
Figure 13:
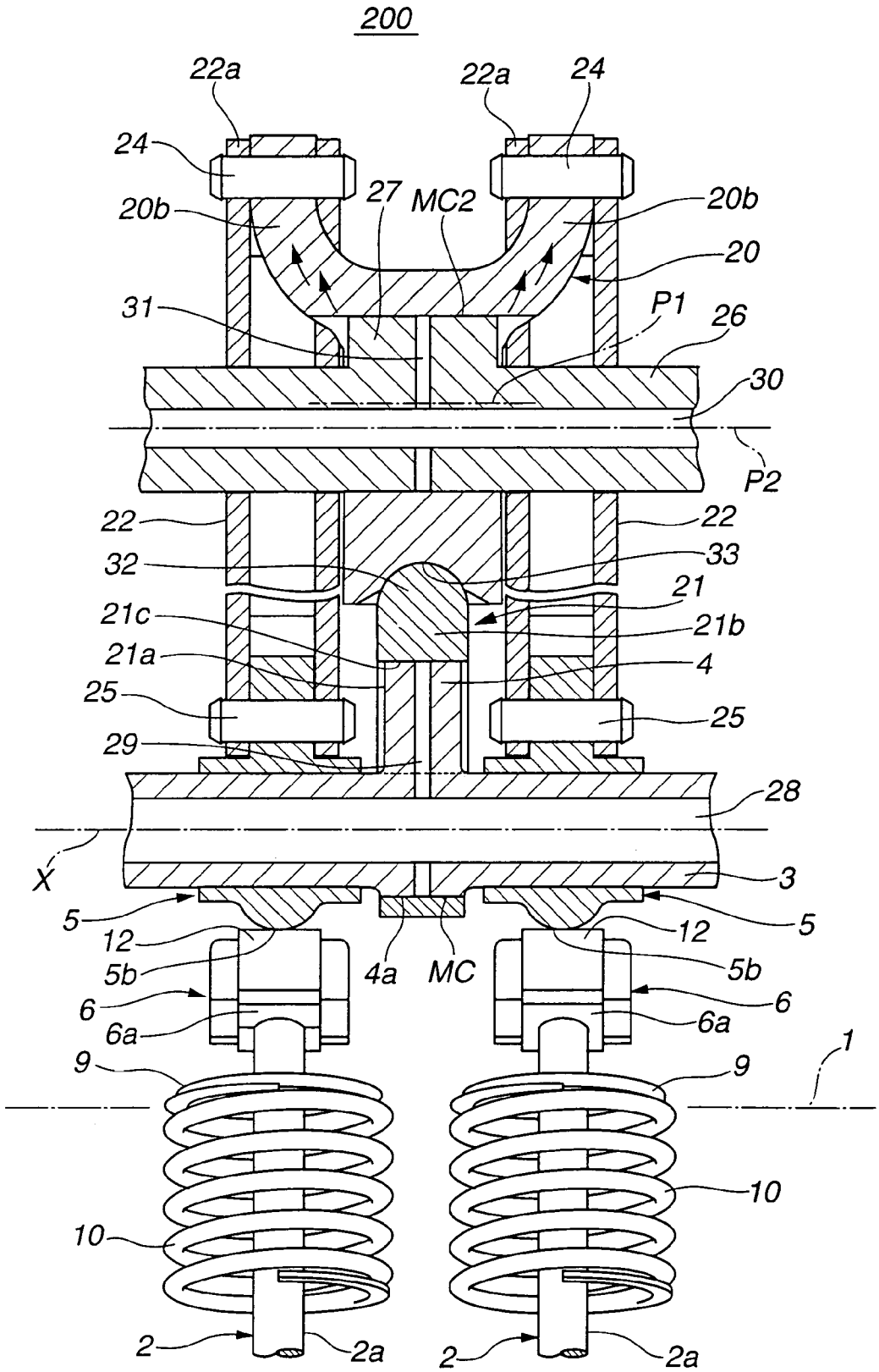
FIG. 13 is a view similar to FIG. 1, but showing the valve operating mechanism of the second embodiment of the present invention.

Referring to FIGS. 12 and 13, there is shown a valve operating mechanism 200 of an internal combustion engine, which is a second embodiment of the present invention.

As is best seen from FIG. 12, in this second embodiment 200, arm portion 21*b* of link arm 21 and first arm portion 20*a* of rocker arm 20 are connected through a so-called pivot structure. That is, arm portion 21*b* is formed with a semispherical head 32 that is slidably received in a semispherical recess 33 formed in first arm portion 20*a* of rocker arm 20.

Furthermore, a return spring 35 is compressed between first arm portion 20*a* and a rocker cover 34 so that rocker arm 20 is biased to turn in a clockwise direction in FIG. 12, that is, in a direction to press semispherical recess 33 of rocker arm 20 against semispherical head 32 of link arm 21.

Due to the nature of the pivotal structure as mentioned hereinabove, a positional misregistration between link arm 21 and rocker arm 20 is sufficiently absorbed and thus much improved force transmission from link arm 21 to rocker arm 20 is expected. Biasing first arm portion 20*a* of rocker arm 20 toward spherical head 32 of link arm 21 by return spring 35 brings about an improved tracking movement of rocker arm 20 particularly when arm portion 21*b* of link arm 21 takes a lower position.

Of course, due to the similar construction to valve operating mechanism 100 of the first embodiment, valve operating mechanism 200 of this second embodiment has a satisfied lubrication effect to the parts.

Figure 14:
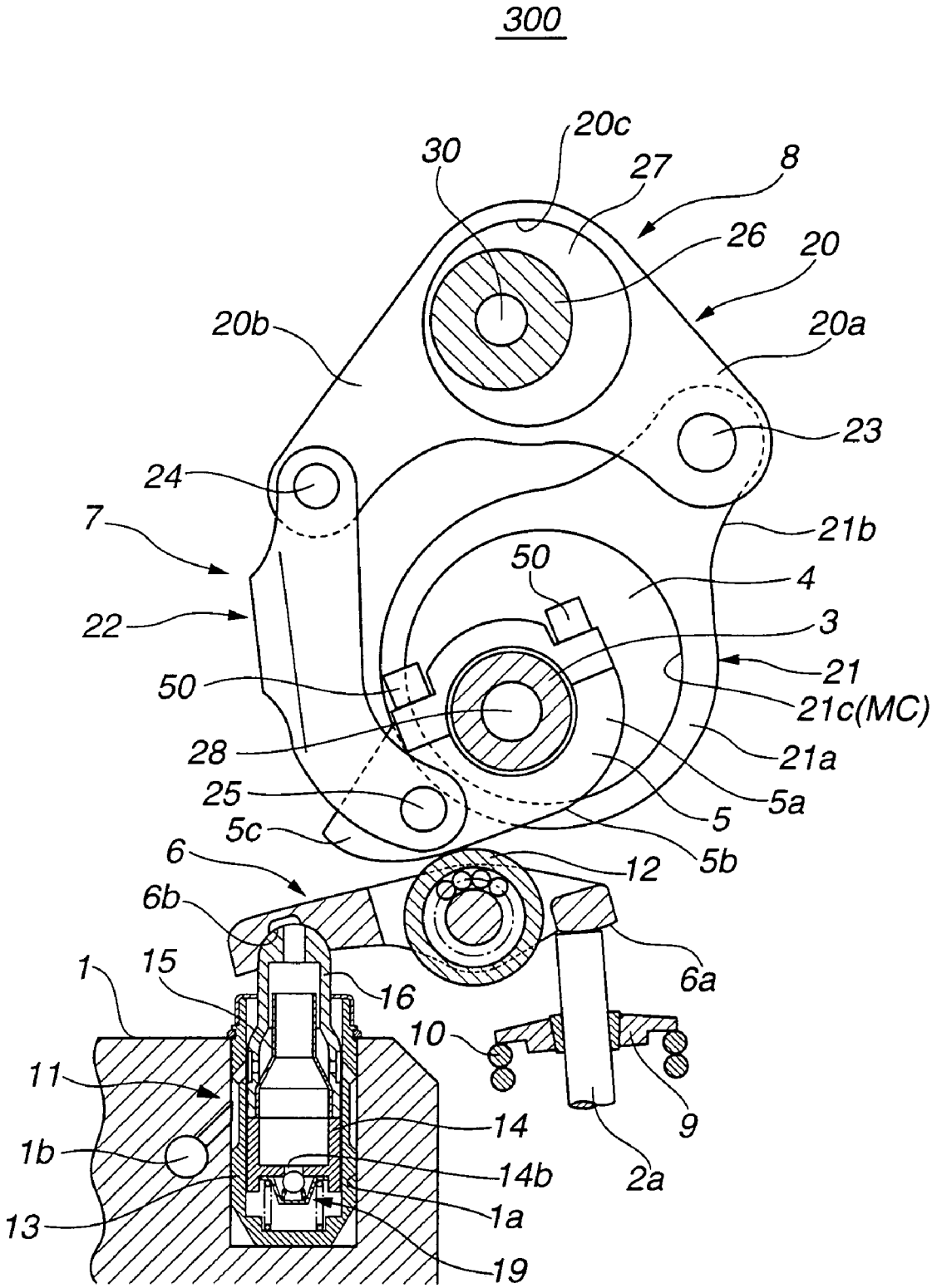
FIG. 14 is a view similar to FIG. 9A, but showing a valve operating mechanism of a third embodiment of the present invention.

Referring to FIG. 14, there is shown a valve operating mechanism 300 of an internal combustion engine, which is a third embodiment of the present invention.

As is well understood when comparing FIG. 14 and FIG. 4, in this third embodiment 300, the arrangement of the unit including movement transmission mechanism 7 and valve lift control mechanism 8 relative to swing arms 6 and 6 is opposite to the arrangement of the first embodiment 100.

Thus, in this third embodiment 300, cam nose portion 5*c* of each swing cam 5 is positioned near pivot member 11, and link arm 21 is positioned near valve stems 2*a* and 2*a* of corresponding intake valves 2 and 2. Due to this neighboring arrangement of the parts, the lubricating oil from the minute clearance "MC" between link arm 21 and drive cam 4 is easily splashed toward spring retainers 9 and 9 and valve springs 10 and 10 to lubricate the same. Furthermore, the lubricating oil flowing down along cam surfaces 5*b* and 5*b* of swing cams 5 and 5 falls onto swing cams 6 and 6 near pivot members 11 and 11.

Figure 15:
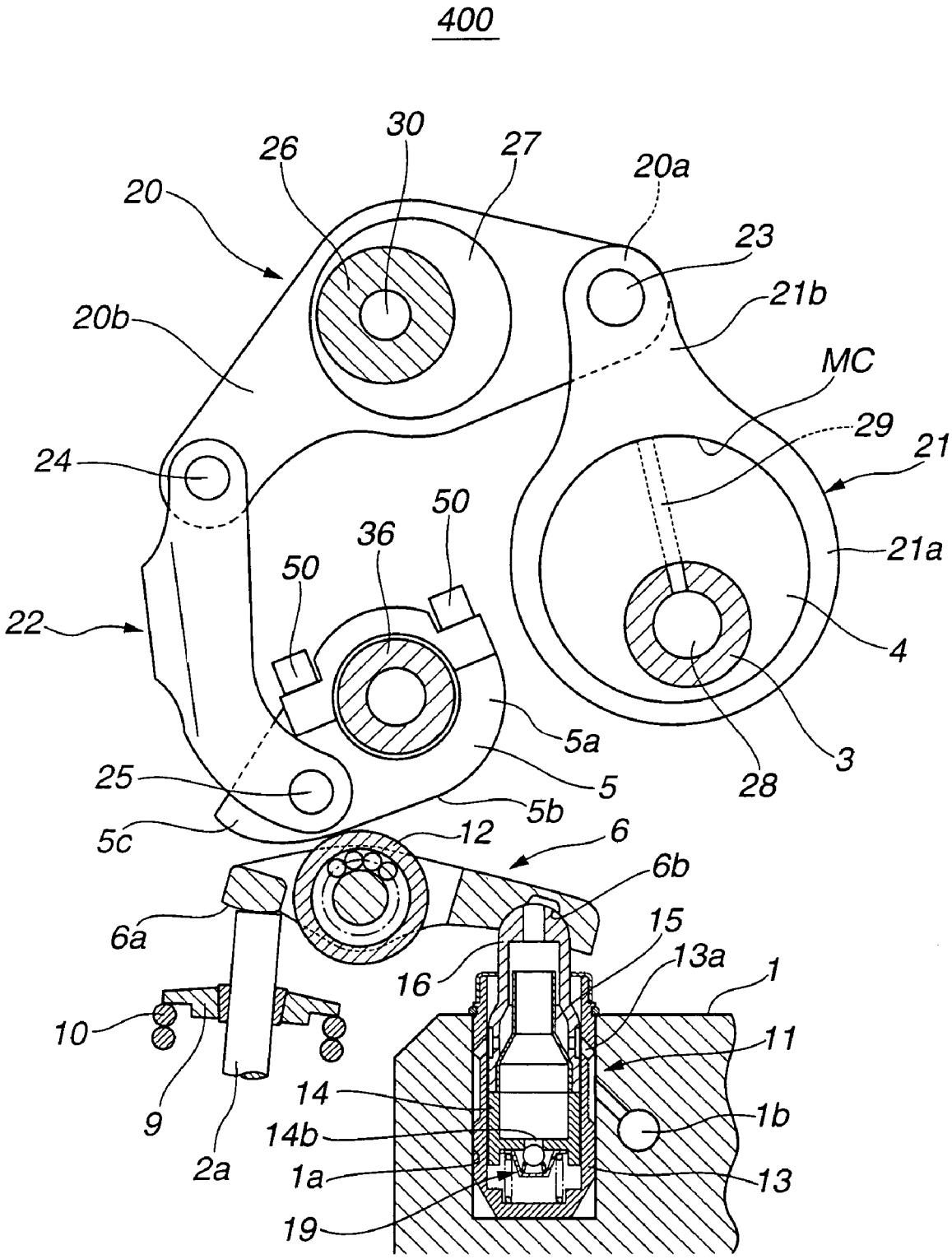
FIG. 15 is a view similar to FIG. 9A, but showing a valve operating mechanism of a fourth embodiment of the present invention.
Figure 16:
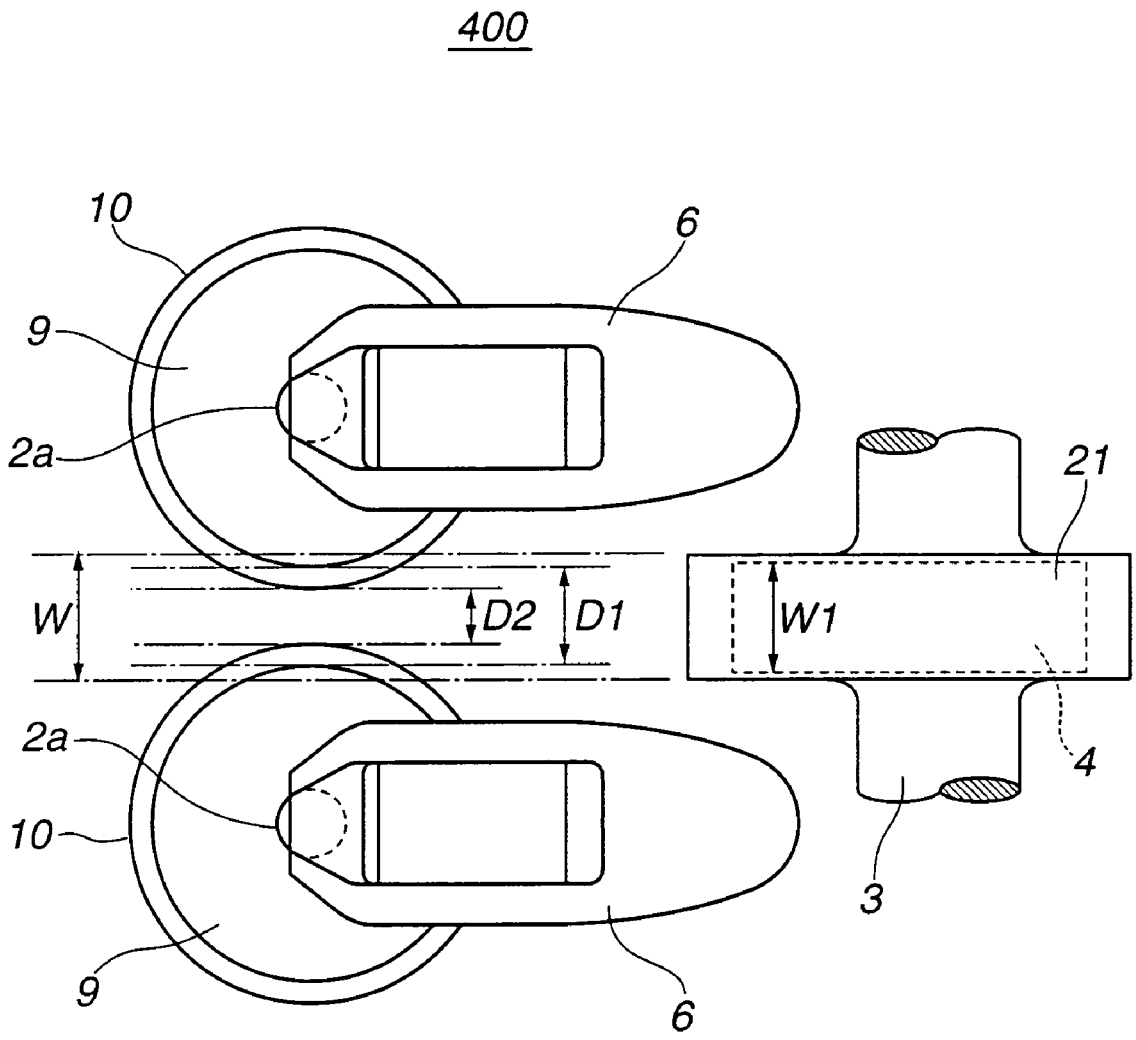
FIG. 16 is a view similar to FIG. 6, but showing a case of the fourth embodiment of FIG. 15.

Referring to FIGS. 15 and 16, there is shown a valve operating mechanism 400 of an internal combustion engine, which is a fourth embodiment of the present invention.

As is seen from FIG. 15, in this fourth embodiment 400, swing cams 5 and 5 are supported by a supporting shaft 36, not by drive shaft 3. Although not shown in the drawing, supporting shaft 36 is tightly held by stand members to which the bearing members for control shaft 26 are connected. The stand members are mounted on cylinder head 1. Drive shaft 3 is rotatably held by bearing members that are arranged on cylinder head 1.

As is seen from FIG. 16, like in the first embodiment 100, the thickness "W" of larger annular portion 21*a* of link arm 21 is slightly larger than the thickness "W1" of drive cam 4 and somewhat larger than the distance "D1" between the adjacent spring retainers 9 and 9 and larger than the distance "D2" between the adjacent valve springs 10 and 10. Thus, the advantageous lubricating oil feeding phenomenon, which is exclusively obtained from such dimensional relationship among W, W1, D1 and D2 as has been mentioned in the section of the first embodiment 100, is also obtained in this fourth embodiment 400.

In the fourth embodiment 400, since swing cams 5 and 5 are supported by supporting shaft 36, not by drive shaft 3. Thus, the valve operating mechanism of this embodiment has a higher degree of freedom in part-layout.

Figure 17:
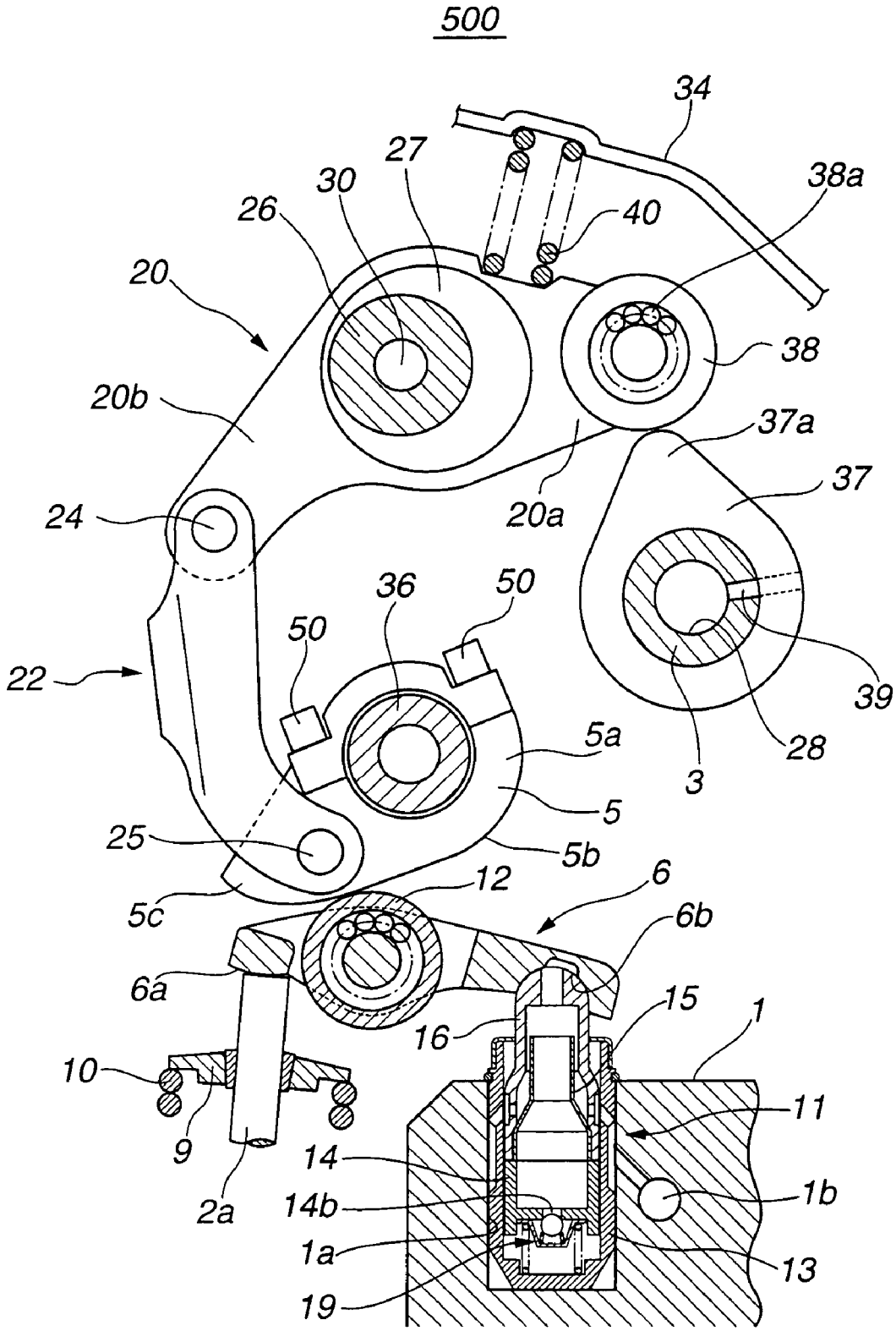
FIG. 17 is a view similar to FIG. 9A, but showing a valve operating mechanism of a fifth embodiment of the present invention.
Figure 18:
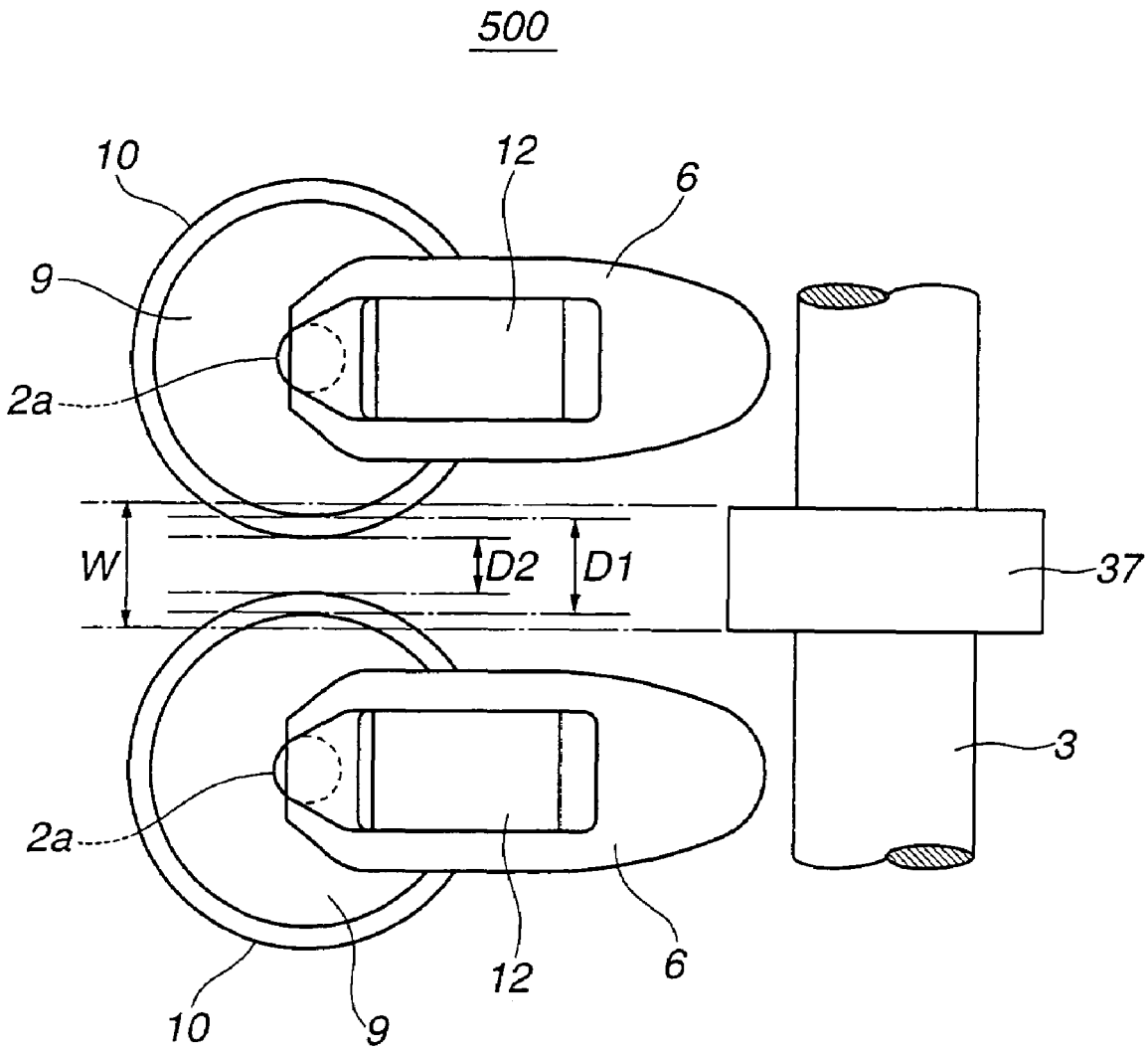
FIG. 18 is a view similar to FIG. 6, but showing a case of the fifth embodiment of FIG. 17.

Referring to FIGS. 17 and 18, there is shown a valve operating mechanism 500 of an internal combustion engine, which is a fifth embodiment of the present invention.

Valve operating mechanism 500 of this fifth embodiment is substantially the same as the above-mentioned fourth embodiment 400 except the following.

In this embodiment 500, like in the fourth embodiment 400, swing cams 5 and 5 is supported by supporting shaft 36, not by drive shaft 3.

However, in this embodiment 500, a raindrop-shaped cam 37 secured to drive shaft 3 is used as a substitute for drive cam 4 used in the first embodiment 100.

That is, as is seen from FIG. 17, a cam nose portion 37*a* of cam 37 is in contact with a roller 38 that is rotatably connected to first arm portion 20*a* of rocker arm 20. A ball bearing 38*a* is used for the rotatable connection of roller 38 to first arm portion 20*a* of rocker arm 20. Denoted by numeral 39 is a branch oil passage that extends in a circular base portion of cam 37 and drive shaft 3 to connect with first oil passage 28 of drive shaft 3.

Like in the second embodiment 200, a return spring 40 is compressed between first arm portion 20*a* of rocker arm 20 and rocker cover 34 so that rocker arm 20 is biased to turn in a clockwise direction in FIG. 17, that is, in a direction to press roller 38 against cam 37.

As is seen from FIG. 18, in this fifth embodiment 500, the thickness "W1" of the raindrop-shaped cam 37 is somewhat larger than the distance "D1" between the adjacent spring retainers 9 and 9 and larger than the distance "D2" between the adjacent valve springs 10 and 10.

Referring back to FIG. 17, upon rotation of drive shaft 3, cam 37 is rotated together therewith due to the integral connection therebetween. During rotation of cam 37, roller 38 of rocker arm 20 is pressed up by cam nose portion 37*a* of cam 37 and then pressed down by return spring 40, so that rocker arm 20 is continuously rocked about control cam 27. Thus, when, like in the first embodiment 100, first arm portion 20*a* of rocker arm 20 is raised by cam nose portion 37*a* of cam 37 through roller 38, two second arm portions 20*b* and 20*b* of rocker arm 20 are lowered causing intake valves 2 and 2 to make their opening movement through link rods 22 and 22, swing cams 5 and 5 and swing arms 6 and 6 against the biasing force of valve springs 10 and 10.

Under turning of cam 37, the lubricating oil in first oil passage 28 is thrown to the outside from branch oil passage 39 due to a centrifugal force applied to the oil. Thus, surrounding parts, such as, spring retainers 9 and 9, valve springs 10 and 10, rocker arm 20, link rods 22 and 22 and swing cams 5 and 5 are adequately supplied with the lubricating oil and thus optimally lubricated with the oil. Furthermore, the dimensional relationship among W1, D1 and D2 (see FIG. 18), lubrication of spring retainers 9 and 9 and valve springs 10 and 10 is optimally carried out.

In this fifth embodiment 500, a simple construction is employed for converting the rotary motion of drive shaft 3 to the swing motion of rocker arm 20, as compared with first, second, third and fourth embodiments 100, 200, 300 and 400. Thus, reduction in cost and higher degree of freedom in part-layout are expected in this firth embodiment 500.

Figure 19:
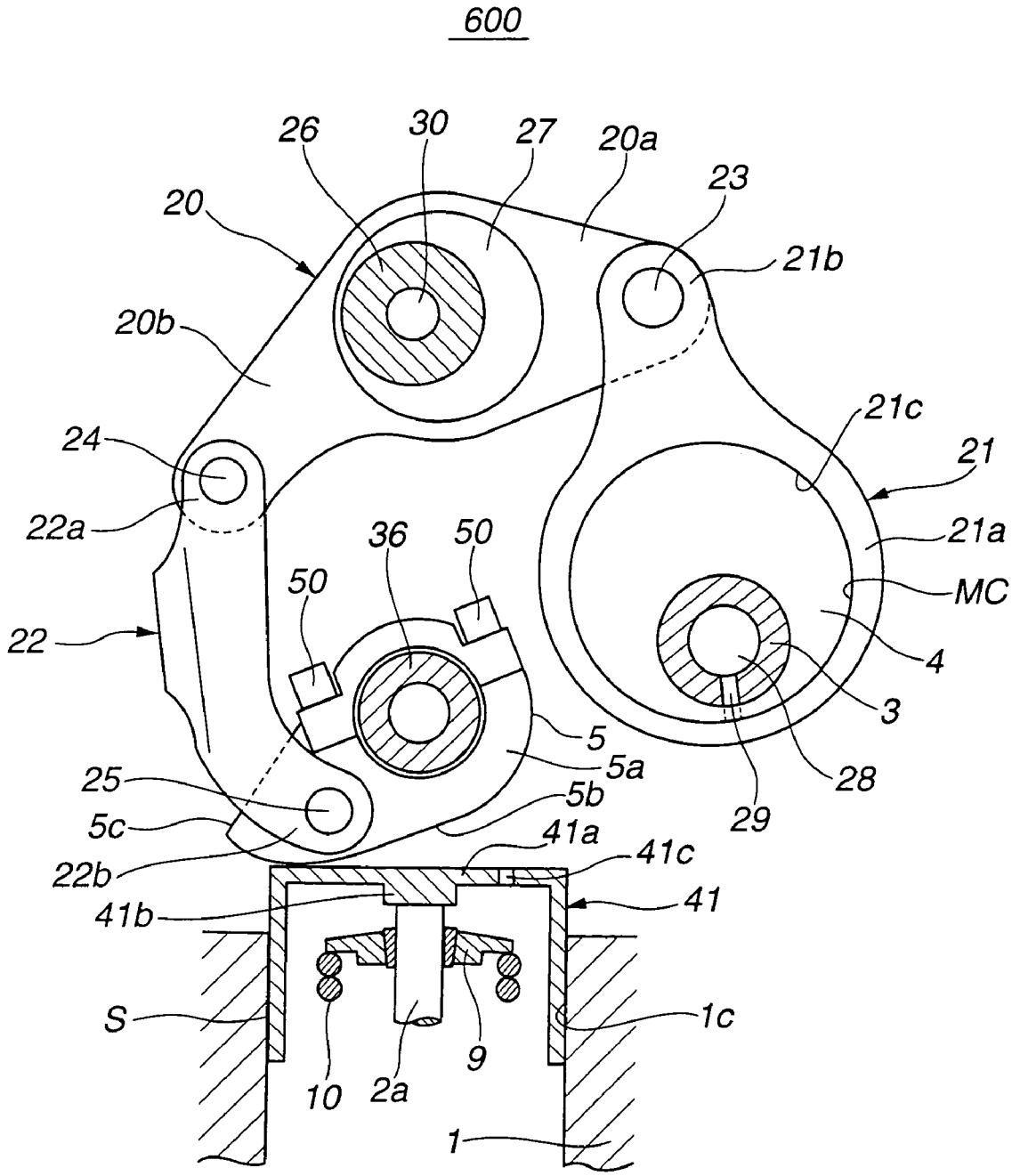
FIG. 19 is a view similar to FIG. 9A, but showing a valve operating mechanism of a sixth embodiment of the present invention.
Figure 20:
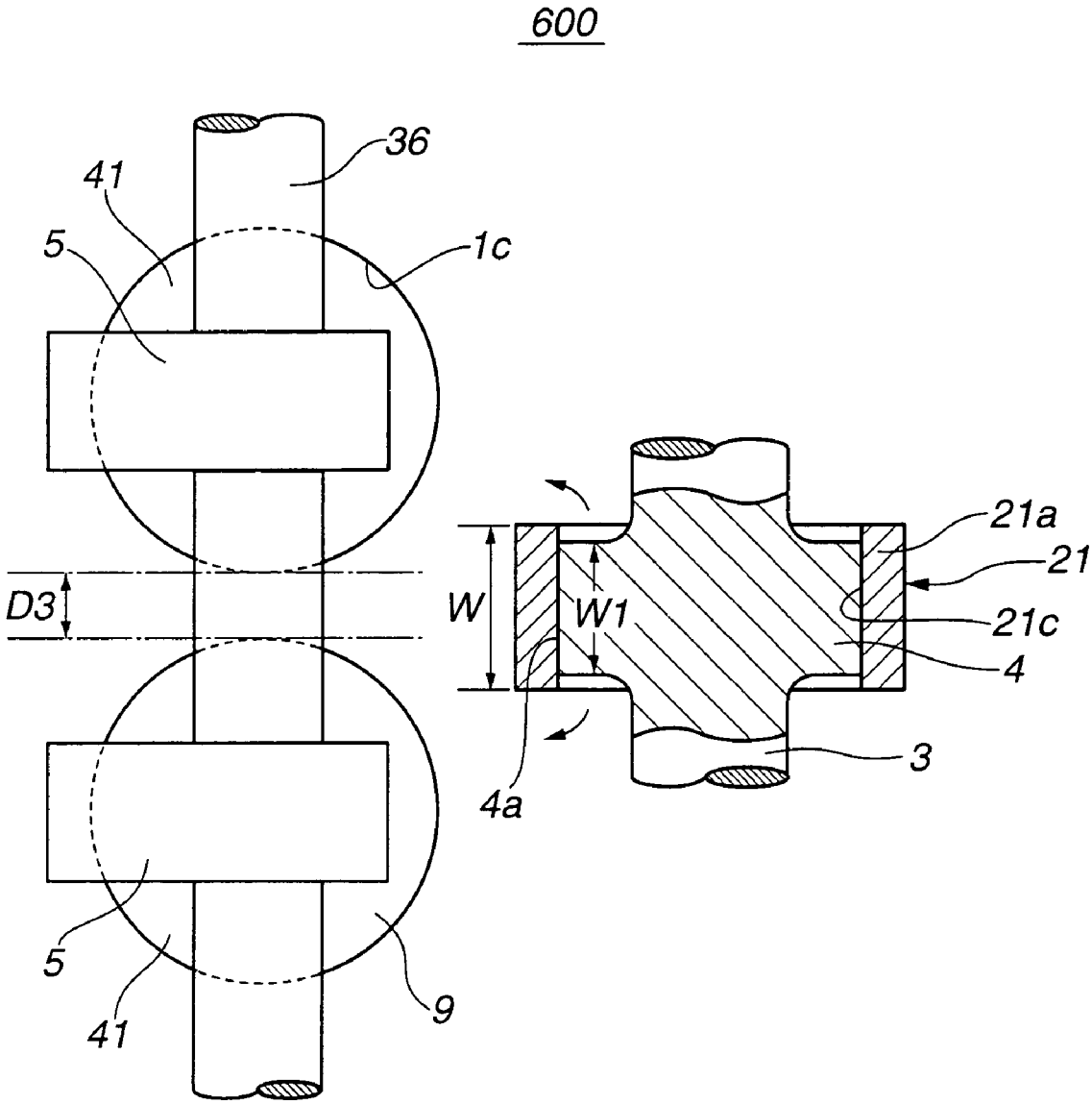
FIG. 20 is a view similar to FIG. 6, but showing a case of the sixth embodiment of FIG. 19.

Referring to FIGS. 19 and 20, there is shown a valve operating mechanism 600 of an internal combustion engine, which is a sixth embodiment of the present invention.

Valve operating mechanism 600 is substantially the same as the above-mentioned fourth embodiment 400 except the following.

That is, as is seen from FIG. 19, in this sixth embodiment 600, valve lifters 41 and 41 are used in place of swing arms 6 and 6.

Each valve lifter 41 comprises a cylindrical case with a head 41*a*, that is slidably received in a cylindrical bore 1*c* formed in cylinder head 1. Head 41*a* has a downward projection 41*b* against which the top of valve step 2*a* abuts. Head 41*a* is formed with an oil opening 41*c*.

As is seen from FIG. 20, the thickness "W" of larger annular portion 21*a* of link arm 21 is slightly larger than the thickness "W1" of drive cam 4 and larger than a distance "D3" between two valve lifters 41 and 41.

As is seen from FIG. 19, in operation, the lubricating oil in first oil passage 28 of drive shaft 3 is led to the minute clearance "MC" between drive cam 4 and link arm 21 through branch oil passage 29 to carry out a lubrication at the clearance "MC" and then, the lubricating oil in the clearance "MC" is thrown radially outward due to rotation of drive cam 4 in circular opening 21*c* of link arm 21. Thus, heads 41*a* and 41*a* of valve lifters 41 and 41 are supplied with a sufficient amount of lubricating oil. The oil then flows on each head 41*a* and enters a minute clearance "S" defined between an inner wall of cylindrical bore 1*c* of cylinder head 1 and a cylindrical outer wall of lifter 41 to carry out the lubrication in the clearance "S". The lubricating oil on the head 41*a* of each valve lifter 41 drops from oil opening 41*c* onto spring retainer 9 and valve spring 10. With the oil led to these parts 9 and 10, the upper end of valve stem 2*a* and downward projection 41*b* of head 41*a* are suitably lubricated during their reciprocating movement.

The entire contents of Japanese Patent Application 2004-39431 filed Feb. 17, 2004 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A valve operating mechanism of an internal combustion engine, comprising: a drive cam rotatable with and eccentric to a drive shaft; a link arm having a circular opening in which the drive cam is rotatably received, so that rotation of drive cam about an axis of the drive shaft produces a swing movement of the link arm; a pair of swing cams swingably disposed on the drive shaft at both sides of the drive cam, the swing cams being connected though a movement transmission mechanism to the link arm to be swung when the link arm is subjected to the swing movement; a pair of swing arms respectively actuated by the swing cams for carrying out an open/close operation of a pair of engine valves; a pair of spring retainers respectively provided by the pair of engine valves; a pair of valve springs respectively held by the spring retainers and biasing the engine valves in a close direction; and an oil passage formed in the drive cam, the oil passage having one end exposed to an oil feeding passage formed in the drive shaft and the other end exposed to a minute clearance defined between a cylindrical outer surface of the drive cam and a cylindrical inner surface of the circular opening of the link arm.

2. A valve operating mechanism of an internal combustion engine as claimed in claim 1, further comprising a lubricating oil receiving member that is movable together with the engine valves, at least a part of the lubricating oil receiving member being arranged in a projected width of the drive cam.

3. A valve operating mechanism as claimed in claim 2, in which the lubricating oil receiving member is a valve lifter that has an upper surface to which one of the swing cams operatively contacts.

4. A valve operating mechanism as claimed in claim 2, in which the lubricating oil receiving member is a spring retainer that holds a valve spring of an engine valve.

5. A valve operating mechanism as claimed in claim 2, further comprising a pair of swing arms that are respectively actuated by the swing cams for carrying out the open/close operation of the paired engine valves, the swing arms being arranged to have a condition to put therebetween the drive cam.

6. A valve operating mechanism as claimed in claim 2, further comprising: a link arm having a circular opening in which the drive cam is rotatably received, so that rotation of the drive cam about an axis of the drive shaft produces a swing movement of the link arm; and a link mechanism through which the link arm and the swing cams are linked, so that the swing movement of the link arm brings about a swing movement of the swing cams.

7. A valve operating mechanism as claimed in claim 6, in which a thickness of the link arm is larger than a thickness of the drive cam.

8. A valve operating mechanism as claimed in claim 2, in which the drive cam is rotatably supported by a supporting shaft that is different from the drive shaft.

9. A valve operating mechanism as claimed in claim 2, in which at least a part of the lubricating oil receiving member is arranged in a projected width of the drive cam.

10. A valve operating mechanism as claimed in claim 1, in which a thickness of the link arm is larger than either one of a distance between the spring retainers and a distance between the valve springs.

11. A valve operating mechanism as claimed in claim 1, in which the link arm is positioned above the spring retainers with respect to a gravitational direction.

12. A valve operating mechanism as claimed in claim 1, in which the swing cams are symmetrically arranged with respect to the drive cam.

13. A valve operating mechanism as claimed in claim 1, in which each of the swing arms has a fulcrum operatively held by a lash adjuster.

14. A valve operating mechanism as claimed in claim 13, in which the lash adjuster is of a hydraulic type wherein a controlled hydraulic pressure is applied to the fulcrum of the swing arm.

15. A valve operating mechanism as claimed in claim 1, in which each of the swing arms has a roller rotatably connected thereto, the roller being in contact with the corresponding one of the swing cams.

16. A valve operating mechanism as claimed in claim 15, in which the roller is rotatably held through a shaft in a through bore formed in the swing arm, the through bore extending generally vertically.

17. A valve operating mechanism as claimed in claim 16, in which the roller is equipped at its axially opposed ends with respective ball bearings through which the roller is supported by the shaft.

18. A valve operating mechanism as claimed in claim 1, in which under operation of the drive cam, at least a part of the minute clearance is able to be positioned nearer to the engine valves than a contact point between each swing cam and the corresponding swing arm is positioned.

19. A valve operating mechanism as claimed in claim 1, in which the movement transmission mechanism is incorporated with a valve lift control mechanism that varies a lift degree of each engine valve in accordance with an operation condition of the engine.

20. A valve operating mechanism as claimed in claim 19, in which the valve lift control mechanism is constructed to continuously vary the lift degree of each engine valve in accordance with the operation condition of the engine.

21. A valve operating mechanism as claimed in claim 20, in which the valve lift control mechanism is constructed to finely control the lift degree of each engine valve even when the lift degree is very small.

22. A valve operating mechanism as claimed in claim 20, in which the valve lift control mechanism is controlled to finely control the lift degree of each engine valve even when the lift degree is substantially zero.

23. A valve operating mechanism as claimed in claim 1, in which the movement transmission mechanism comprises: the link arm; a rocker arm pivotally held by a control shaft, the rocker arm being pivotally connected to the link arm; and a pair of link rods through which the rocker arm and the paired swing cams are linked, wherein the rocker arm comprises a first arm portion pivotally connected to the rink arm and a forked second arm portion pivotally connected to the link rods, so that when the link arm is subjected to the swing movement, the movement is transmitted to the swing cams to swing the same through the first and second arm portions of the rocker arm and the link rods.

24. A valve operating mechanism as claimed in claim 23, in which the movement transmission mechanism is incorporated with a valve lift control mechanism, the valve lift control mechanism comprising: the control shaft, an angular position of the control shaft being varied in accordance with an operation condition of the engine; and a control cam securely and eccentrically mounted on the control shaft, the control cam being rotatably received in a supporting bore formed in a middle portion of the rocker arm, wherein when, due to turning of the control shaft, the control cam changes its angular position, a swing mode of the rocker arm is changed thereby to vary the lift degree of each engine valve.

25. A valve operating mechanism as claimed in claim 23, in which the link arm, the first arm portion of the rocker arm, the forked second arm portion of the rocker arm, the link rods and the swing cams are pivotally connected through a link mechanism.

26. A valve operating mechanism as claimed in claim 1, in which the drive cam is integral with the drive shaft.

27. A valve operating mechanism of an internal combustion engine, comprising: a drive cam rotatable with and eccentric to a drive shaft; a link arm having a circular opening in which the drive cam is rotatably received, so that rotation of the drive cam about an axis of the drive shaft produces a swing movement of the link arm; a pair of swing cams swingably disposed on the drive shaft at both sides of the drive cam, the swing cams being linked to the link arm to be swung when the link arm is subjected to the swing movement; a pair of swing arms respectively actuated by the swing cams for carrying out an open/close operation of a pair of engine valves; a pair of spring retainers respectively provided by the pair of engine valves; a pair of valve springs respectively held by the spring retainers and biasing the engine valves in a close direction; and a lubricating oil supply arrangement comprising: a minute clearance defined between a cylindrical outer surface of the drive cam and a cylindrical inner surface of the circular opening of the link arm; and oil holding spaces provided at axially both ends of the minute clearance, the holding spaces being positioned above the spring retainers and the valve springs, so that, under operation of the engine, the lubricating oil in the oil holding spaces is permitted to fall onto the spring retainers and the valve springs due to a gravity applied to the lubricating oil.

28. A valve operating mechanism of an internal combustion engine, comprising: a drive cam rotatable with and eccentric to a drive shaft; a link arm having a circular opening in which the drive cam is rotatably received, so that rotation of drive cam about an axis of the drive shaft produces a swing movement of link arm; a pair of swing cams swingably disposed on the drive shaft at both sides of the drive cam, the swing cams being linked to the link arm to be swung when the link arm is subjected to the swing movement; a pair of swing arms respectively actuated by the swing cams for carrying out an open/close operation of a pair of engine valves; a pair of spring retainers respectively provided by the pair of engine valves; a pair of valve springs respectively held by the spring retainers and biasing the engine valves in a close direction; an a lubricating oil supply arrangement including: a minute clearance defined between a cylindrical outer surface of the drive cam and a cylindrical inner surface of the circular opening of the link arm; oil holding spaces provided at axially both ends of the minute clearance to temporarily hold therein a lubricating oil coming out from the minute clearance; and an oil throwing means that enforcedly throws the lubricating oil in the oil holding spaces toward given portions of the spring retainers and the valve springs, the given portions being upper surfaces of the spring retainers and the valve springs with respect to a gravitational direction.

* * * * *